US005906539A

United States Patent [19]

Tabel

[11] Patent Number: 5,906,539

[45] Date of Patent: May 25, 1999

[54] WORK STATION FOR TURRET TOOLING

[75] Inventor: Paul D. Tabel, Mt. Prospect, Ill.

[73] Assignee: Certified Tool & Manufacturing Corporation, Elk Grove Village, Ill.

[21] Appl. No.: 08/674,013

[22] Filed: Jul. 1, 1996

[51] Int. Cl.[6] ..... B24B 41/06

[52] U.S. Cl. ..... 451/403; 451/411; 248/188.2; 269/289; 269/291

[58] Field of Search ..... 451/364, 411, 451/404, 403, 365, 401, 406; 269/289 R, 291, 297, 66, 57, 909; 248/314, 188.2; 211/163

[56] References Cited

U.S. PATENT DOCUMENTS

| | | | |
|---|---|---|---|
| 1,027,419 | 5/1912 | Hines | 269/57 |
| 1,243,577 | 10/1917 | Arrants | 451/411 |
| 2,369,425 | 2/1945 | Becker | 269/297 |
| 2,921,487 | 1/1960 | Schabot | 269/65 |
| 4,165,669 | 8/1979 | Brown et al. . | |
| 4,658,688 | 4/1987 | Shah et al. . | |
| 5,042,352 | 8/1991 | Lux . | |
| 5,044,239 | 9/1991 | Endo et al. . | |
| 5,048,385 | 9/1991 | Eckert et al. . | |
| 5,062,337 | 11/1991 | Johnson et al. . | |
| 5,215,513 | 6/1993 | Maynard et al. . | |
| 5,269,739 | 12/1993 | Maynard et al. . | |
| 5,318,496 | 6/1994 | Takahashi . | |
| 5,330,241 | 7/1994 | Takahashi . | |
| 5,394,335 | 2/1995 | Rush . | |
| 5,615,451 | 4/1997 | Peterson et al. | 248/188.2 |
| 5,618,028 | 4/1997 | Hepworth | 451/406 |

OTHER PUBLICATIONS

Quick Ordering Guide (Thick Turret Tooling 1–1/4" Station); Wilson Tool International, Catalog No. 151 Q.O.G, Effective Date Jun. 1, 1993 (3 pages).

Multi–Tool Punches, Strippers and Dies product literature; Standard Tooling, p. 6; Finn–Power Tooling Pricelist, Effective Sep. 1, 1994.

Quick–Set Style Nova Tooling for Finn–Power Turret Punch Presses; Standard Tooling, p. 5; Finn–Power Tooling Pricelist, Effective Sep. 1, 1994.

Strippit (Thick Turret Tooling, Performance Plus in Tooling) product literature; ©1992, Strippit, Inc. (pp. 1–12).

Quick Ordering Guide (Fab 1/2", 5/8", 1–1/4" Station); Wilson Tool International, Catalolg No. 154 Q.O.G., Effective Date: Oct. 1, 1993 (4 pages).

Quick Ordering Guide (Thick Turret Series 80 Plus™ & ABS); Wilson Tool International, Catalog No. 153 Q.O.G., Effective Date: Jun. 1, 1993 (3 pages).

Strippit® product literature; The Most Experienced Name in Fabricating Equipment; © 1993 Strippit, Inc. (5 pages).

Wilson Tool International product literature; Premium Thick Turret Tooling; 1990 Edition (pp. 1–37).

*Primary Examiner*—Robert A. Rose
*Attorney, Agent, or Firm*—Wallenstein & Wagner, Ltd.

[57] ABSTRACT

The present invention provides work stations 10 for servicing turret tooling. The work station 10 is portable and includes a rotatable, indexable platter 12 having multiple tool stations defined by cavities 18 within the platter 12. Each tool station 18 is adapted to receive a turret tool. A frame 14 supports the platter 12 and includes areas to store tools and parts used during servicing turret tools. Five unique grinding block fixtures 200, 300, 400, 500, 560 are also provided. The grinding blocks 200, 300, 400, 500, 560 hold the turret tools, punches and dies, in proper positions during grinding and sharpening of the tools.

29 Claims, 14 Drawing Sheets

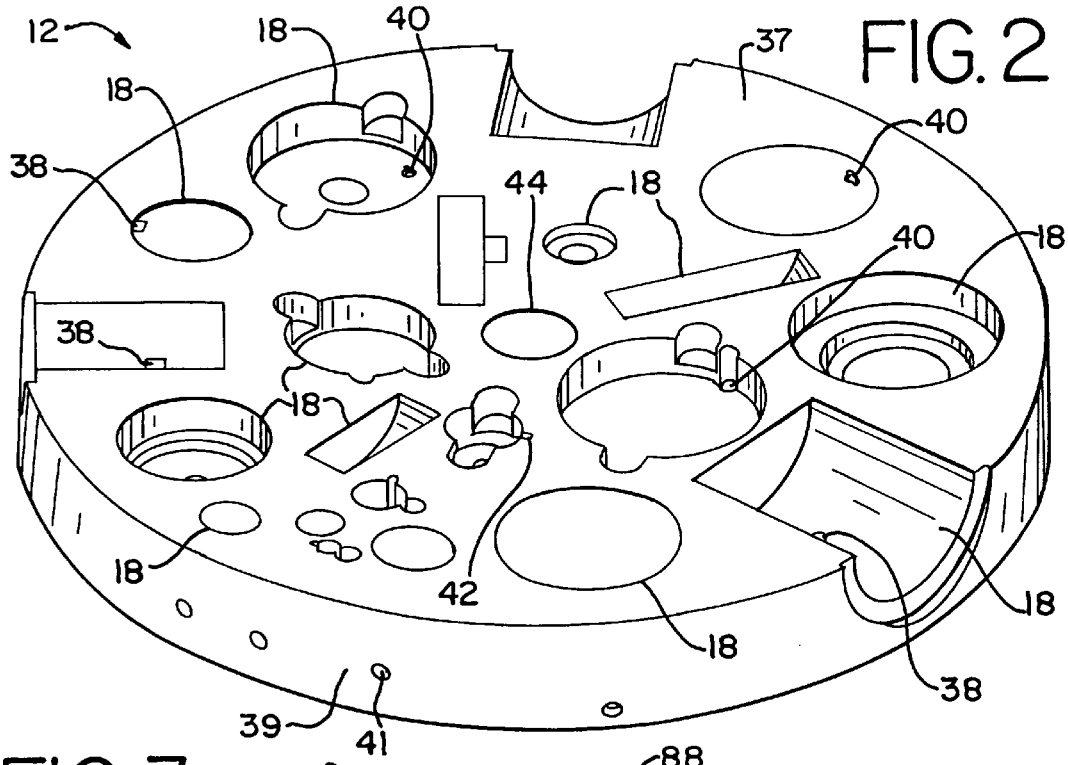
FIG. 2
FIG. 3
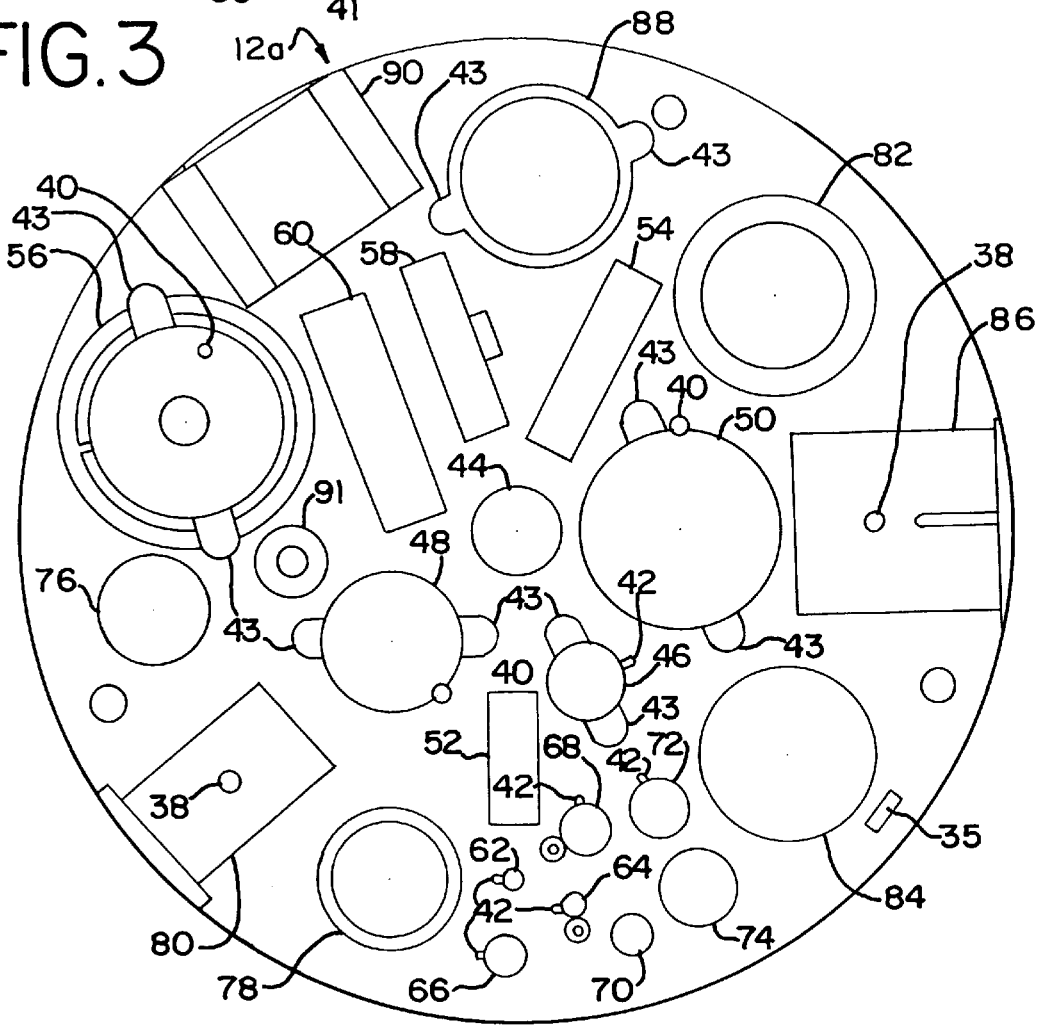

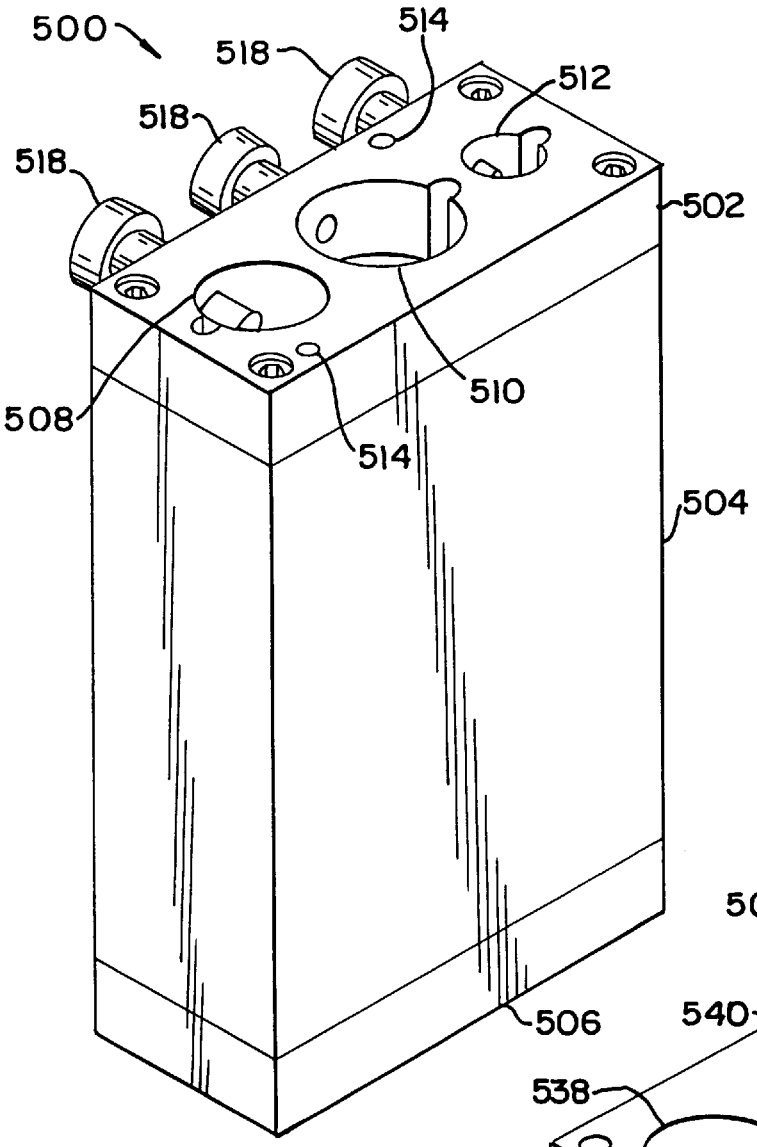
FIG.16
FIG.18
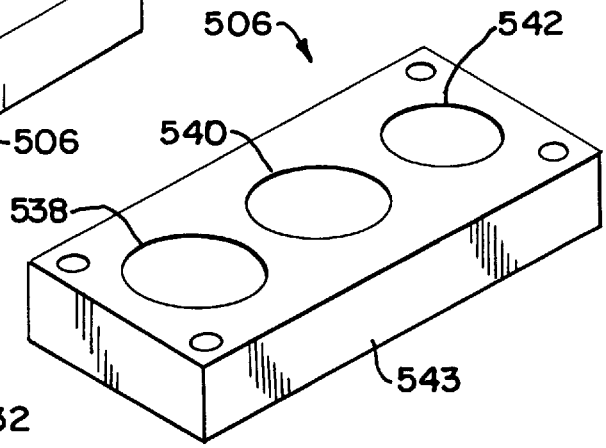
FIG. 17
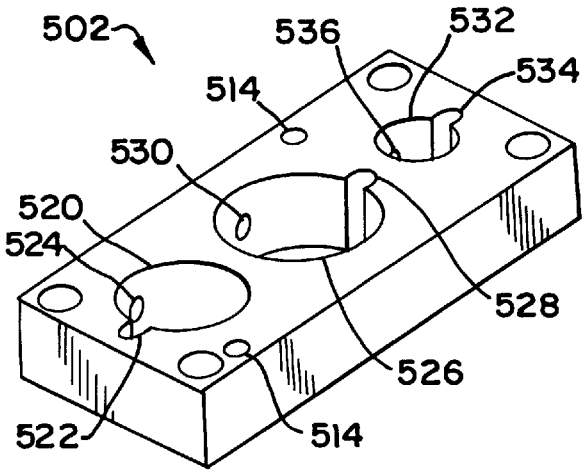

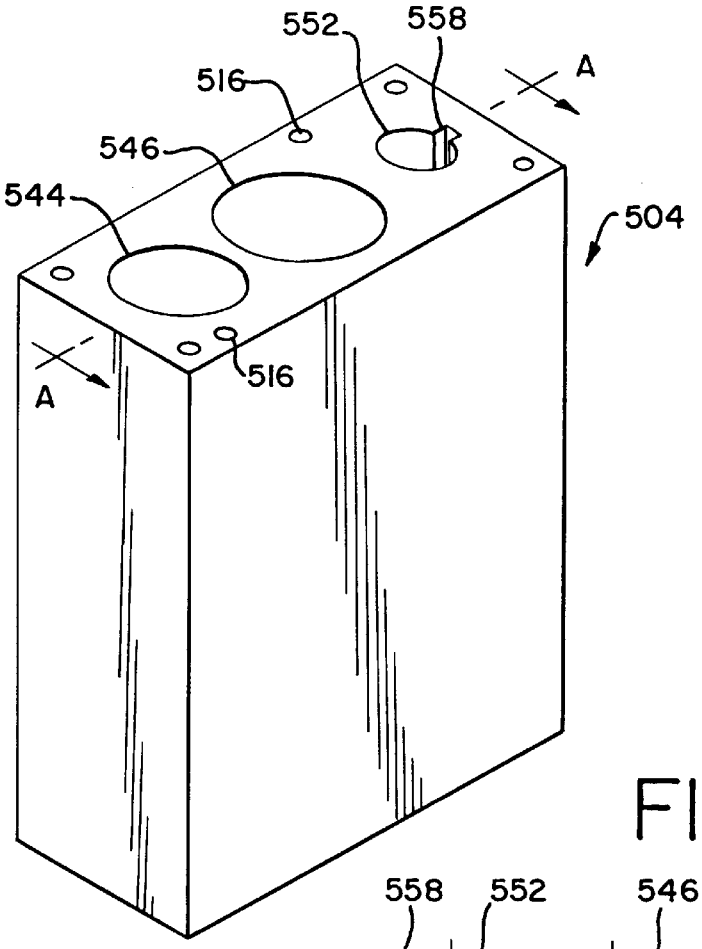
FIG. 19
FIG. 20
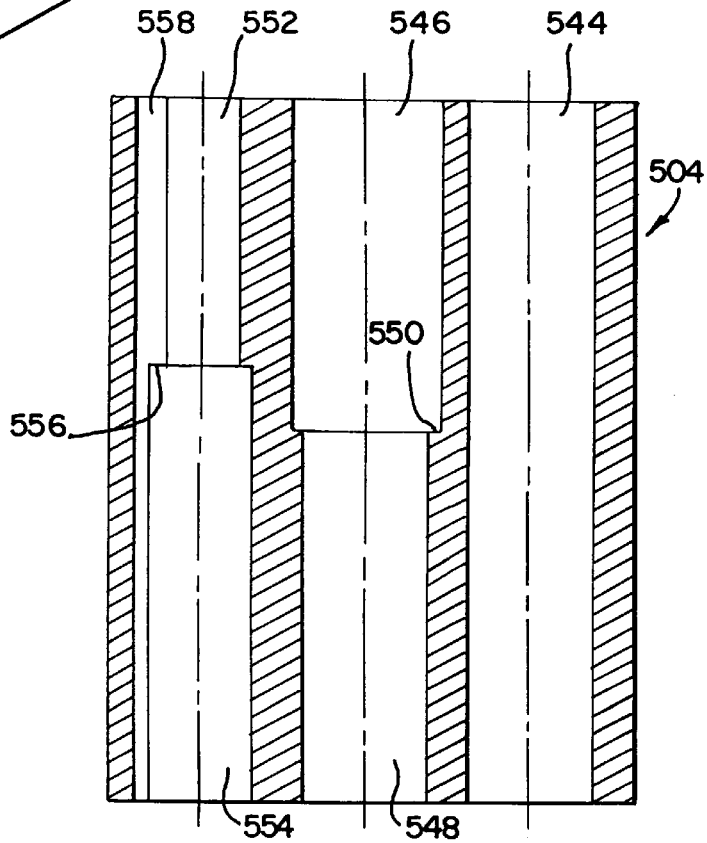

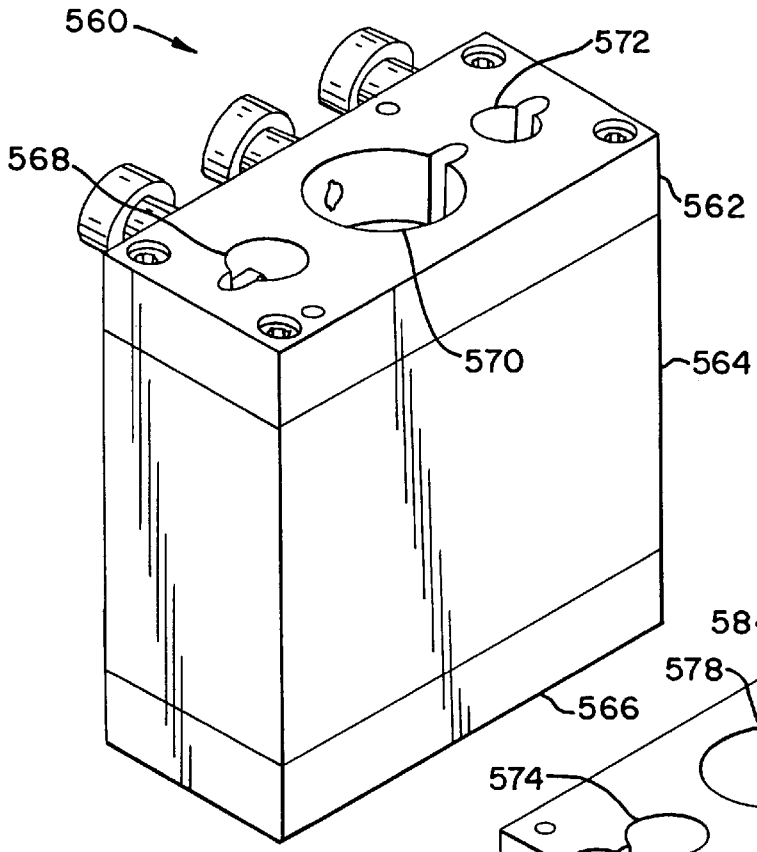
FIG. 21
FIG. 22
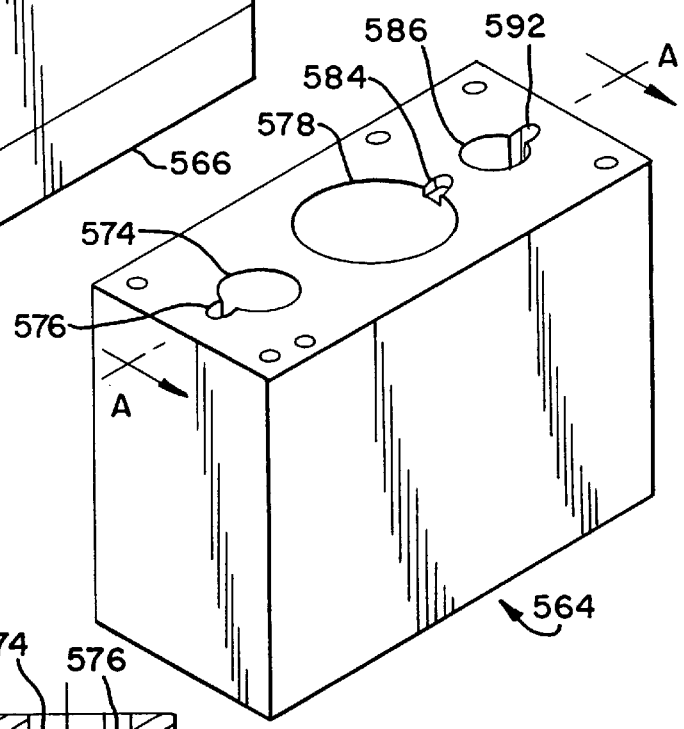
FIG. 23
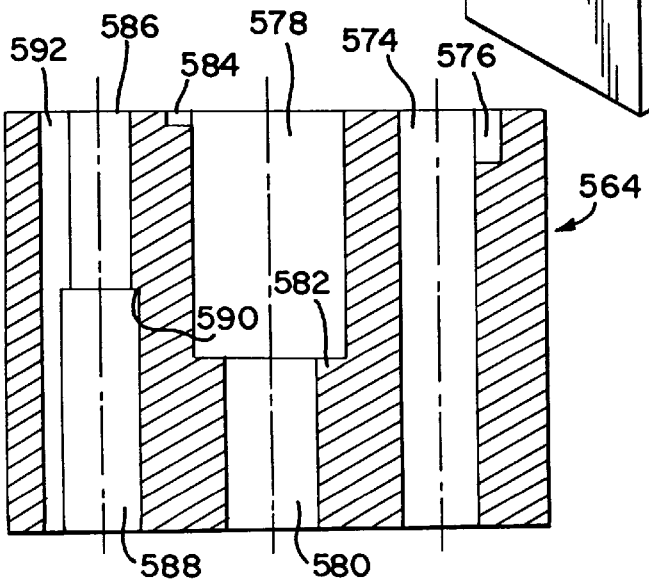

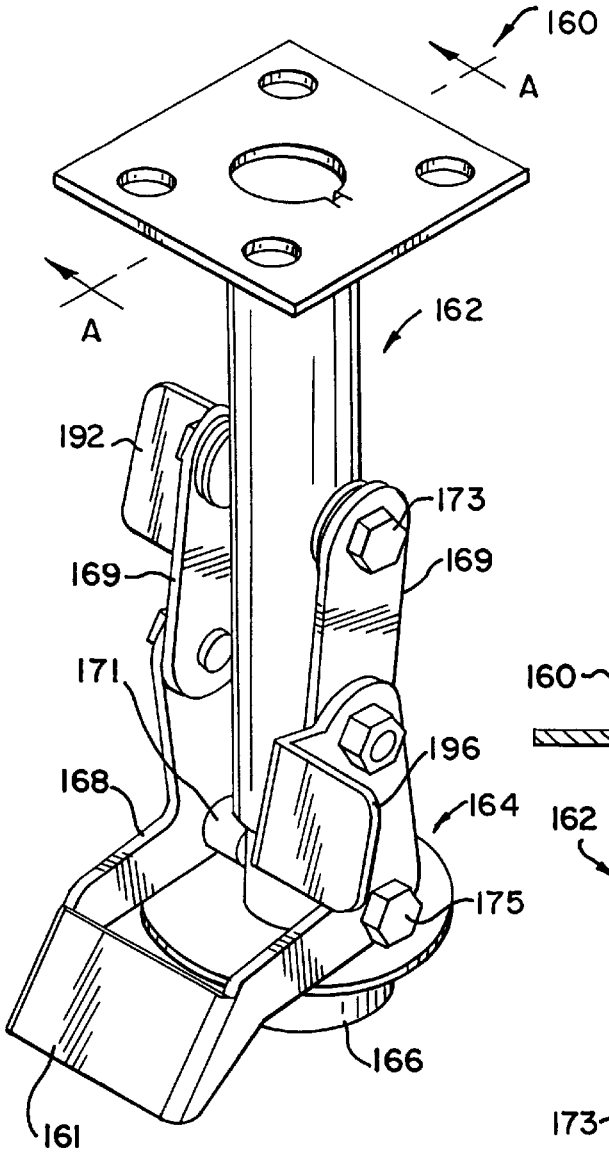
FIG. 24
FIG. 25
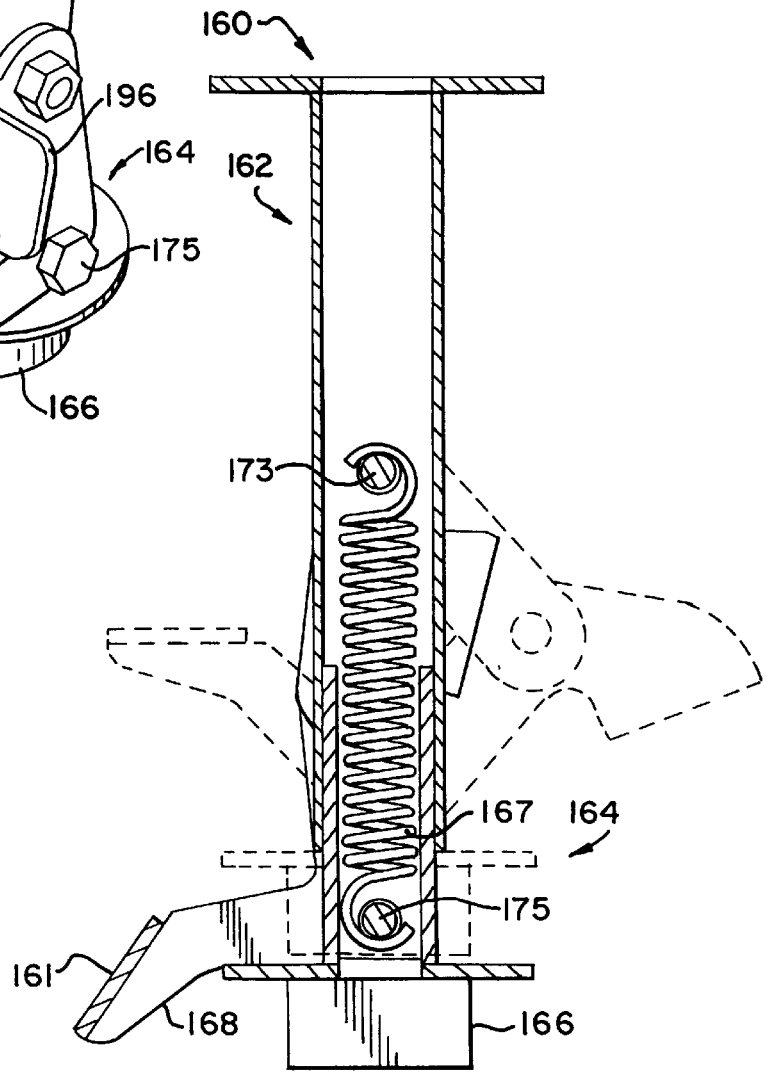

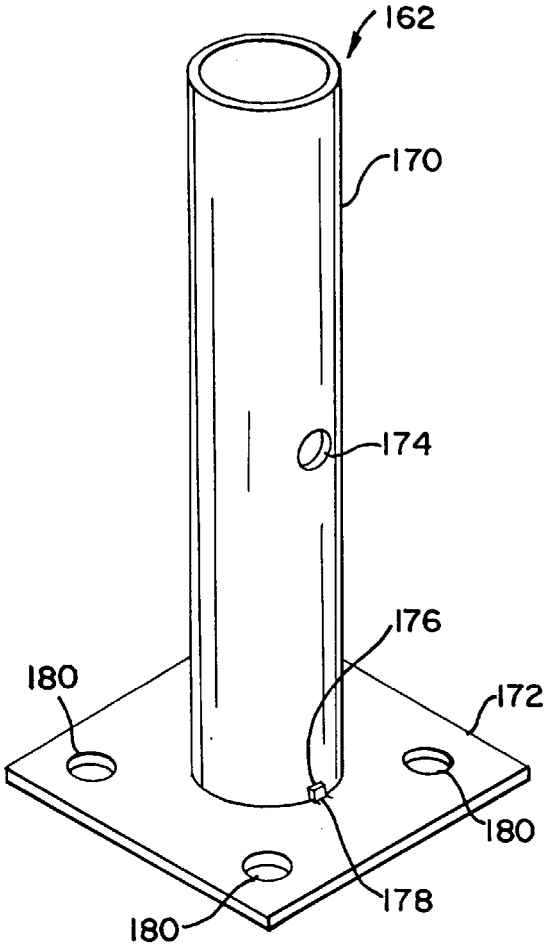
FIG. 26
FIG. 27
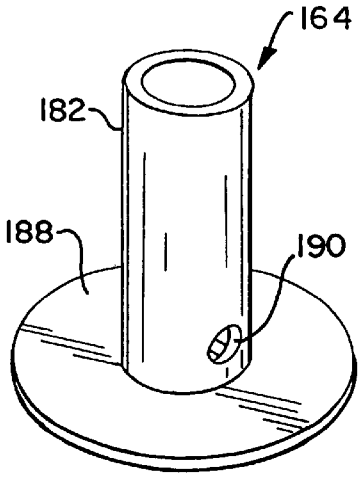
FIG. 28
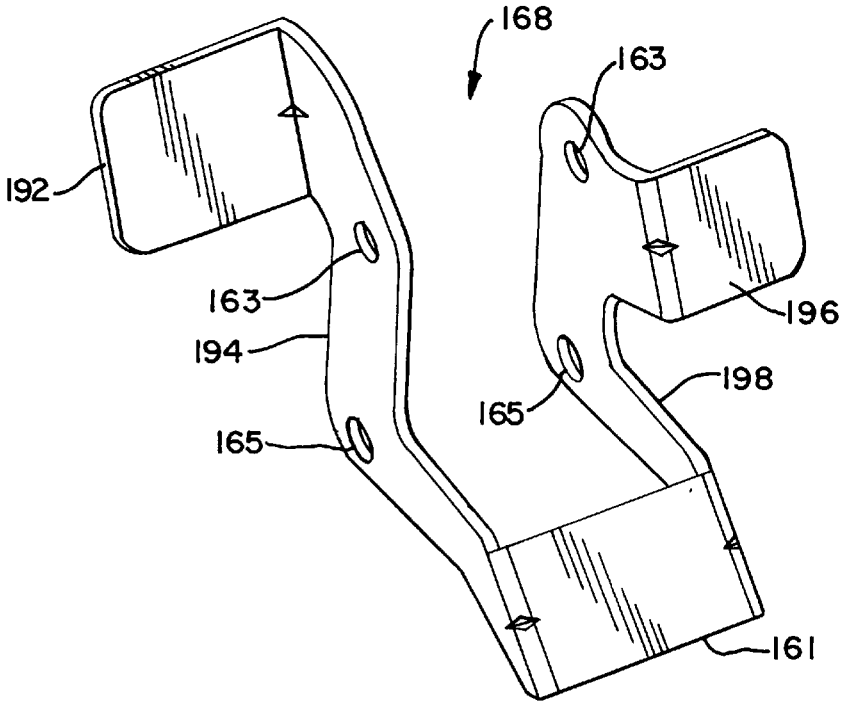

WORK STATION FOR TURRET TOOLING

TECHNICAL FIELD

This invention generally relates to work stations for servicing turret tooling. More specifically, this invention relates to portable work stations for assembly, disassembly, servicing and grinding tooling utilized in turret punch press machines.

BACKGROUND OF THE INVENTION

Turret punch press machines are widely used to manufacture an almost endless array of metal and plastic parts. Turret punch press machines are computer controlled, and are utilized to efficiently and cost effectively manufacture relatively large and small quantities of parts. When a manufacturing machine is not operating, i.e., downtime, manufacturing productivity decreases and manufacturing costs increase. Accordingly, manufacturers strive to minimize machine downtime and maximize production productivity.

Turret punch press machines include a rotatable turret that holds various removable turret tools in various bores spaced apart on the turret. The turret tools perform a particular action on the part being fabricated. Turret tools include punches and dies, for example, which fabricate holes in the parts. Many turret tools have been designated as so-called "thick" and "thin" turret tooling. Turret tools that are "thick" have a longer tool length than tools that are "thin." Turret tooling also includes multi-tool cartridges which have multiple, relatively smaller, tools grouped together in a cartridge. The turret tools may require service for various reasons, such as assembly, disassembly, sharpening, replacement of broken tool components, maintenance, removal of slugs from dies, and repair.

Turret tools have been serviced while being held in the turret or while laying on the turret table. Servicing turret tools in this manner, however, exhibits problems. For example, the turret punch press machine must be shut down during service of the tool. Machine setup time is increased when the tool is assembled utilizing the turret. Shutdown or downtime of the machine reduces efficiency and increases manufacturing costs.

Turret tools have been serviced outside of the turret while placed on a flat work surface or held in a vice. This manner of servicing turret tools, however, also presents problems. For example, the tool may be held incorrectly, which makes the service procedure more difficult, and the tool may be more easily damaged.

Another problem that exists with servicing turret tools is that the tool may move or rotate during the service procedure. For example, round tools may easily rotate during servicing. A tool that is not held in a stationary position can result in difficulties in assembling, disassembling, and performing other service procedures on the tool.

Problems have also been experienced in sharpening tools. The tools may be sharpened by grinding a cutting surface on the tool. Makeshift grinding fixtures have been used to hold tools in a desired position or at a desired angle during grinding. Those makeshift grinding fixtures may not, however, properly hold the tool, which can result in an improperly sharpened or even damaged tool.

Turret tools are commonly ground by placing the tool on a magnetic chuck and engaging a grinding wheel with the tool. Problems exist, however, with grinding turret tools on a magnetic chuck. During grinding, the temperature of the tool increases and a portion, particularly an edge, may lift off of the magnetic chuck. The tool may be ground improperly if a portion of the tool lifts off of the magnetic chuck. Also, the entire tool may completely lift and fly off of the magnetic chuck during grinding.

In the industry, good machine shop practice includes the step of cross-cutting punches and dies during grinding. For example, dies should be ground at a 45° angle so only a portion of the edge of the cutout is sheared at any given moment. The cutting surface of a punch should also be ground at a 45° angle. Good machine shop practices are not, however, always followed because it requires increased time and effort.

Two industry standard turret tool punch grinding procedures include flat top grinding and roof top grinding. Flat top grinding can be achieved by placing the punch on a magnetic chuck such that the punch tip is parallel to the chuck. Roof top grinding forms an angled punch tip, typically having angles of 2½°. Roof top grinding has been achieved by using a "sign bar" and "joe blocks" to form the desired angles on the punch tip. Roof top grinding by this method is, however, cumbersome and difficult to maintain the proper angles.

Another aspect of servicing turret tooling is that various service tools, for example, hand tools, and parts are needed. These service tools and parts have a tendency to become disorganized and inconveniently stored at various places around the manufacturing area or shop floor. Accordingly, service personnel may waste time locating these items instead of servicing the turret tools.

Therefore, these and other needs exist to improve servicing of turret punch press machines. Particularly, needs exist to improve the servicing of turret tooling. The present invention satisfies these and other needs.

Other aspects and advantages of the present invention will become apparent after reading this disclosure, including the claims, and reviewing the accompanying drawings.

SUMMARY OF THE INVENTION

The present invention provides work stations for servicing turret tooling. The work station is also referred to as a rotary assembly and disassembly tool unit (R.A.D.T.). The work station is portable and includes a rotatable, indexable platter having multiple, spaced-part tool stations defined by cavities within the platter. Each tool station is adapted to receive a turret tool. A frame supports the platter and includes areas to store tools and parts used during servicing turret tools. Five unique grinding block fixtures are also provided. The grinding blocks hold the turret tools, punches and dies in proper positions during grinding and sharpening of the tools.

The portable work station can be used for servicing turret tools, for example, assembly, disassembly, sharpening, removal of slugs from dies, replacement of broken tool components, maintenance, and repair. The work station can service so-called "thick" and "thin" turret tooling and all standard tooling and multi-tool punches and dies, including spring and urethane-loaded tools. The work station is compact, lightweight, easily portable, and conveniently stores various tools and parts used during servicing turret tools.

BRIEF DESCRIPTION OF THE DRAWINGS

FIG. 2 is a perspective view of a platter of the work station shown in FIG. 1.

FIG. 3 is a top plan view of a preferred platter of the work station for turret tooling.

FIG. 16 is a perspective view of another grinder punch holder made in accordance with the principles of the present invention.

FIG. 17 is a perspective view of a punch holder top of the grinder punch holder of FIG. 16.

FIG. 18 is a perspective view of a punch holder base of the grinder punch holder of FIG. 16.

FIG. 19 is a perspective view of a punch holder body of the grinder punch holder of FIG. 16.

FIG. 20 is a cross-sectional view of the punch holder body of FIG. 19 taken along line A—A.

FIG. 21 is a perspective view of another grinder punch holder made in accordance with the principles of the present invention.

FIG. 22 is a perspective view of a punch holder body of the grinder punch holder of FIG. 21.

FIG. 23 is a cross-sectional view of the punch holder body of FIG. 22 taken along line A—A.

FIG. 24 is a perspective view of a table lock assembly.

FIG. 25 is a cross-sectional view of the table lock assembly of FIG. 24 taken along line A—A.

FIG. 26 is a perspective view of an upper lock assembly of the table lock assembly of FIG. 24.

FIG. 27 is a perspective view of a lower lock assembly of the table lock assembly of FIG. 24.

FIG. 28 is a perspective view of a lock lever of the table lock assembly of FIG. 24.

DETAILED DESCRIPTION OF THE PREFERRED EMBODIMENT

Although the present invention can be made in many different forms, the preferred embodiments are described in this disclosure and shown in the attached drawings. This disclosure exemplifies the principles of the present invention and does not limit the broad aspects of the invention only to the illustrated embodiments.

Figure 1:
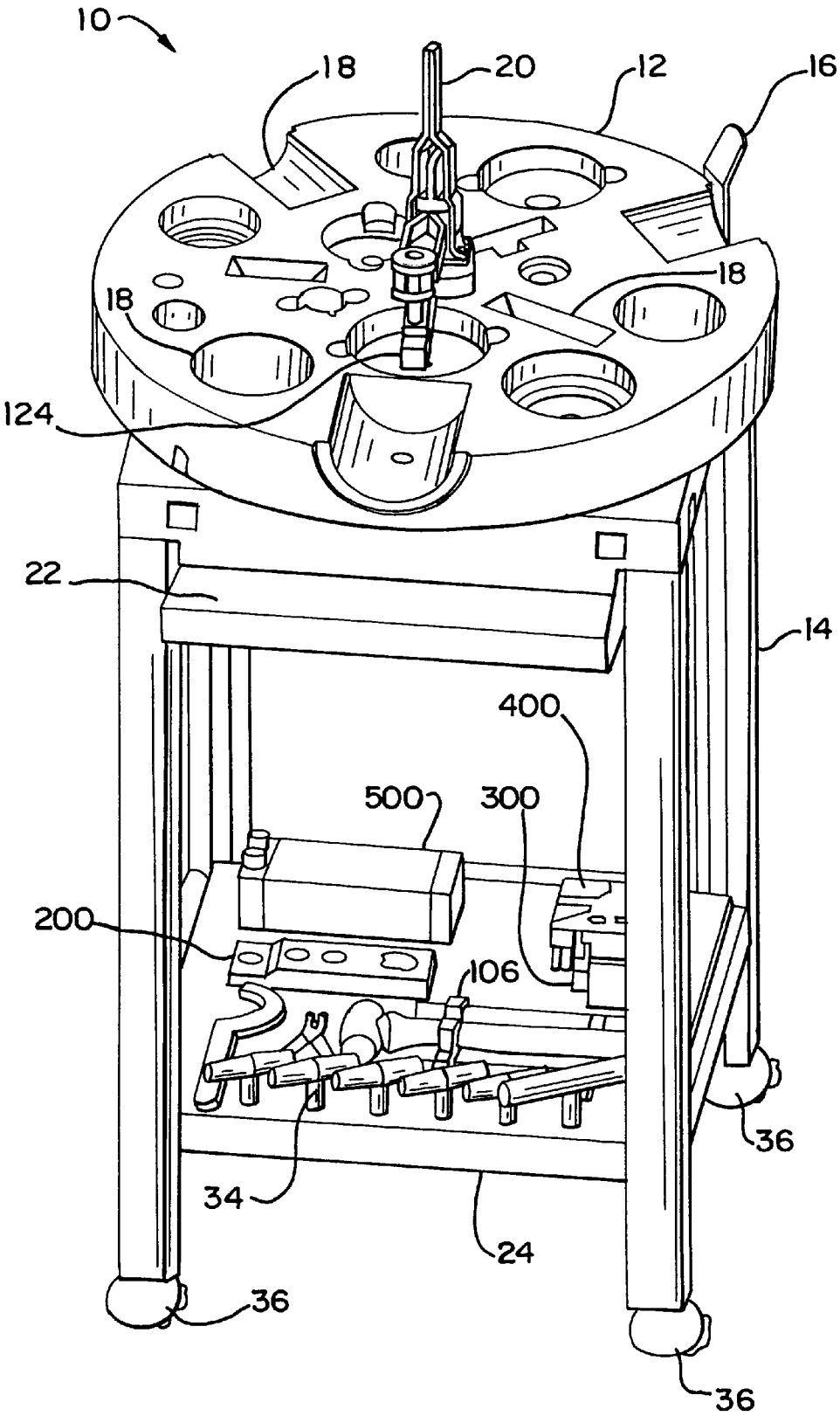
FIG. 1 is a perspective view of a work station for turret tooling made in accordance with the principles of the present invention.

FIG. 1 shows a perspective view of a work station for turret tooling 10 made in accordance with the principles of the present invention. The work station 10 includes a platter 12 supported by a frame 14. Preferably, the platter 12 is rotatably connected to the frame 14. An index lever 16 is movable between first and second positions to alternately lock the platter 12 in position while the index lever 16 is in the first position and to allow the platter to rotate while the index lever 16 is in the second position. Accordingly, the index lever 16 alternately prevents the platter 12 from rotating and allows the platter 12 to rotate.

A plurality of spaced apart cavities 18 in the platter 12 define various tool stations that hold turret tool assemblies during servicing. A clamp assembly 20 is provided to securely hold turret tools in the tool stations 18. The work station 10 further provides a parts tray 22 attached to the frame 14 where various items can be placed. FIG. 1 shows the parts tray 22 attached to the front or operator side of the work station 10. The various items may include, for example, tools, spare parts, shims, snap rings, screws, etc. The parts tray 22 stores these and other items, and provides easy access to the items when needed.

Various tools and items can also be stored on a lower tray 24 of the frame 14 for convenient access. The tools and items stored on the lower tray 24 may include grinding block fixtures 200, 300, 400, 500, 560 and hand tools 34, for example.

The work station 10 is portable in that it can be easily moved from one turret punch press machine to another. The frame 14 may include casters or wheels 36 which allow the portable work station 10 to be rolled between turret punch press machines. One work station 10 made according to the present invention measures 24" wide by 27" deep by 38-⅝" high and weighs only 110 pounds. FIGS. 29–32 show examples of various punches 602, 606, 608 and a die 604 that have been disassembled from their respective tool assemblies.

FIG. 2 shows a perspective view of a platter 12 of the work station 10 shown in FIG. 1. The platter 12 includes various tool stations defined by spaced-apart cavities 18 for receiving and holding turret tools (punches and dies) during servicing. The cavities 18 are recessed into the platter 12 below a horizontal top platter surface 37. Preferably, the platter 12 is constructed from cast aluminum.

The cavities 18, described further below with reference to FIG. 3, are designed to hold various types and sizes of turret tools in various positions. The cavities 18 are dimensioned to conform to the sizes and shapes of the punches and dies to snugly hold them in place. Each cavity 18 has a supporting surface that holds a turret tool in either a vertical or horizontal position. Accordingly, each cavity 18 has either a vertical or horizontal orientation, and defines either a vertical or horizontal axis that corresponds to the position of the tool placed in the cavity 18. A cavity 18 may have a hole extending through the platter 12 so that a portion of a tool, such as a punch, can extend through the platter 12 while being held in the cavity 18. The cavities 18 may be bored or cast into the platter 12 as desired during manufacture of the platter 12. An indicia 35 can be provided for each cavity 18 to identify the turret tools that each cavity 18 is designed to hold. The indicia 35 can be stamped or cast into the platter 12, or applied to the platter 12, by color coding or a label, for example. Similar indicia 35 can be provided on the grinder die holders and grinder punch holders, described below.

Pins 38 or spring plungers 40 may be included in the cavity 18. The pin 38 and spring plunger 40 extend outward from a cavity surface and engage a detent in a turret tool to retain and orient the tool within the cavity 18. A cavity 18 may include a groove 42 that receives and engages a corresponding pin on the turret tool to locate the tool within the cavity 18. Turret tooling is generally cylindrical in shape and round in cross-sectional shape. The pins 38, spring plungers 40 and grooves 42 assist in locating the punches and dies within the cavities 18, and prevent the punches and dies from turning within the cavities 18. Spring plungers 40 can be easily removed and replaced if needed. Because the spring plungers 40 are spring-loaded, turret tools can be placed in a cavity 18 and rotated into engaging position with the spring plunger 40. The spring plungers 40 includes a ball bearing that is spring-loaded and movable within a sleeve so that the ball bearing can move inward or outward when engaging a surface. The ball bearing can engage a detent on an outside surface of a turret tool to locate the tool in place within the cavity 18. The spring plunger 40 has external threads so it can be secured within a threaded bore 41 in the platter 12.

A cavity 18 may be relatively deep and extend downward in close proximity to a turn table 110 (described below with reference to FIG. 4). A spring plunger 40 in such a deep cavity 18 may interfere with the turn table 110. Thus, a pin 38 can be used instead of a spring plunger 40. Spring plungers 40 tend to cause less damage to the turret tools and are less easily damaged than pins 38.

A cavity 18 may also have one or more finger recesses 43 adjacent the cavity 18. An operator can insert a finger into a finger recess 43 to assist in removal of a turret tool from the cavity 18. The circularly shaped platter 12 has an annular surface 39 extending downward from a radially outermost edge of the top platter surface 37. The annular outside surface 39 has holes 41 extending into the platter 12. The holes 41 are provided for installation and removal of the spring plungers 40 and the pins 38.

A hole 44 through the center of the platter 12 is provided for the clamp assembly 20 as described below.

FIG. 3 is a top plan view of a preferred platter 12*a* of the work station for turret tooling 10. The platter 12*a* shown in FIG. 3 is similar to the platter 12 shown in FIG. 2 except that a different cavity pattern is shown. The cavity pattern (number, size and location of cavities) can be chosen such that the work station 10 can be used with a variety of turret tools.

Each cavity shown in FIG. 3 is designed to accommodate particular turret tools as follows. Standard die cavities 46, 48, 50, 52, 54 are designed to hold standard dies. Upright standard die cavities 46, 48, 50 hold standard 1¼", 2" and 3½" dies, respectively, in a vertical, upright position. The upright standard die cavities 46, 48, 50 are cast cavities. The standard 1¼", 2" and 3½" dies usable in the cavities 46, 48, 50 may be spring-loaded or urethane-loaded. Horizontal standard die cavities 52, 54 hold standard 2" and 3½" dies, respectively, in a sideways, horizontal position.

Multi-tool cavities 56, 58, 60 are designed to hold multi-tool dies. Upright multi-tool cavity 56 is a two size cast cavity that holds both large and small multi-tool dies in vertical, upright positions. The upright multi-tool cavity 56 includes a first area having a first inside diameter corresponding to an outside diameter of a small multi-tool die, and a second area having a second inside diameter, larger than the first inside diameter, which corresponds to an outside diameter of a larger multi-tool die. The first and second inside diameters of the multi-tool cavity 56 are concentric, and the first inside diameter is recessed further downward into the cavity 56 than the second inside diameter. Horizontal multi-tool die cavities 58, 60 hold small and large multi-tool dies, respectively, in a sideways, horizontal position.

A ½" punch body cavity 62, a ⅝" punch body cavity 64, a thick turret punch body drop in cavity 66, and a 1¼" punch body cavity 68 hold their respectively sized punch bodies in a vertical, upright position. A ½" thick turret punch assembly cavity 70, a 1¼" thin turret punch assembly cavity 72, and a 1¼" thick turret punch assembly 74 hold their respectively sized punch assemblies in a vertical, upright position. Two upright 2" punch assembly cavities 76, 78 hold 2" punches in a vertical, upright position, and a horizontal 2" punch cavity 80 holds a 2" punch in a sideways, horizontal position. Two upright 3½" punch assembly cavities 82, 84 hold 3½" punches in a vertical, upright position, and a horizontal 3½" punch cavity 86 holds a 3½" punch in a sideways, horizontal position. The cavities 76 and 84 are holes bored through the platter 12*a*, and hold their respective punches with the punch tip extending downward through the bored hole. The punch tip may extend through a thick turret tool hole 122 (shown in FIG. 4). The cavities 78 and 82 are cast cavities, having a counterbored shape, which hold their respective punches with the tip extending upward. An upright multi-punch assembly cavity 88 holds multi-tool punches in a vertical, upright position, and a horizontal multi-tool punch cavity 90 holds multi-tool punches in a sideways, horizontal position.

A counterbored hole 91 is provided to hold the stepped shaft of a multi-tool. The counterbored hole 91 holds the multi-tool in an upright position, particularly for servicing the strippers on the multi-tool. The stepped shaft of the multi-tool can be placed within the counterbored hole 91 during servicing of the multi-tool. The hole 91 permits the shaft ends of the tools in the multi-tool to be retained in their proper position after removal of the multi-tool snap ring.

Figure 4:
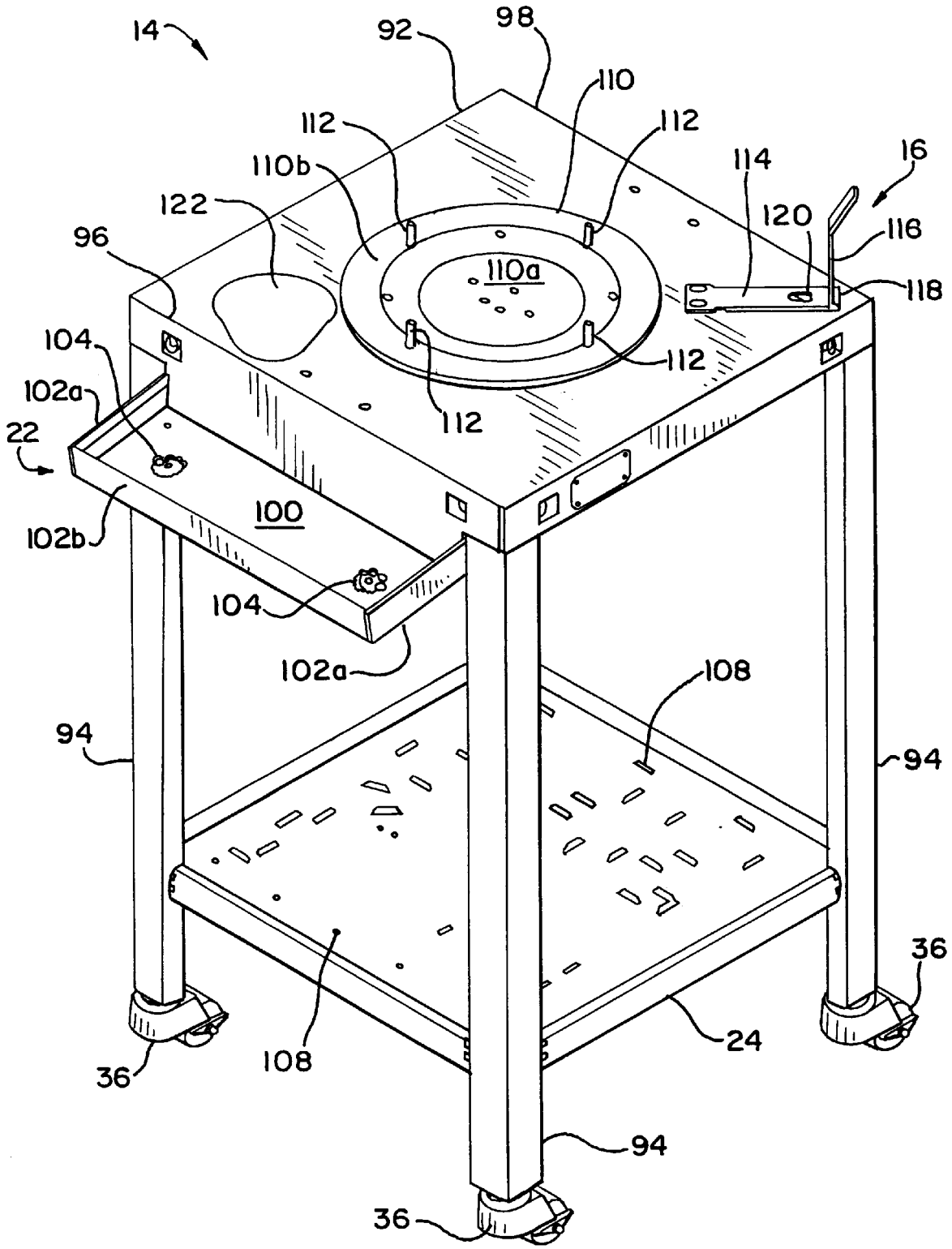
FIG. 4 is a perspective view of a frame of the work station shown in FIG. 1.

FIG. 4 shows a perspective view of the frame 14 of the work station 10. The frame 14 includes an upper tray 92 attached to legs 94 that extend downward from the upper tray 92. A reinforcement bar (not shown) may be attached to the bottom of the upper tray 92 and extend from one edge 96 of the upper tray 92 across the middle of the upper tray 92 to an opposite edge 98 of the upper tray 92. The reinforcement bar provides additional upper tray strength to support the platter 12, and prevents the upper tray 92 from flexing when the clamp assembly 20 clamps a turret tool in an cavity 18. The lower tray 24 is attached to the legs 94 at a location below the upper tray 92. The casters 36 are attached to the ends of legs 94 opposite from the leg ends attached to the upper tray 92.

The parts tray 22 is also attached to the frame 14 and, preferably, the parts tray 22 is formed integrally with the upper tray 92. The parts tray 22 is adapted to hold loose items used in the service of turret tools. The parts tray 22 includes a bottom 100 and side walls 102*a*, 102*b* that extend upwardly from the bottom 100. The bottom 100 is slanted relative to a horizontal plane such that loose items contained in the parts tray 22 may slide toward the outer side wall 102*b*. In this manner, the parts tray 22 provides a person repairing a turret tool with easy access to loose items contained in the parts tray 22. The bottom 100 may include holes 104 sized to receive hand tools, for example, allen wrenches. The parts tray bottom 100 may include a series of holes 104 to receive a series of different sized tools. For example, FIG. 4 shows a series of holes 104 arranged in a circular pattern for various sizes of allen wrenches. Of course, the size, shape and pattern of the holes 104 can be varied as desired to accommodate specific tools.

The lower tray 24 is attached to the frame 14, particularly the legs 94, at a location below the upper tray 92. The lower tray 24 provides structural support to the frame 14 and an area to hold loose items. The items stored on the lower tray 24 may include hand tools 34 and grinding blocks 200, 300, 400, 500, 560, some of which are shown in FIG. 1, for example. Holding clips 106 (FIG. 1) may be provided on the lower tray 24 to removably secure the items to the lower tray 24 during storage of the items. Also, the lower tray 24 may include holes 108 (FIG. 4) through the lower tray 24, similar to the holes 104 in the parts tray 22, in which the items may be inserted during storage.

Referring to FIG. 4, a turn table 110 is rotatably connected to the upper tray 92. The turn table 110 defines an open area 110a in the center of the turn table 110 and an annular ring 110*b* circumscribes the open area 110*a*. The turn table open area 110*a* permits mounting of the clamp assembly 20 to the upper tray 92 as described below. The platter 12 is attached to the turn table 110, particularly to the annular ring 110*b*, by upstanding projections or screws 112. Accordingly, the turn table 110 supports the platter 12 such that the platter 12 is rotatable relative to the upper tray 92. The platter 12 and the turn table 110 can rotate 360° in clockwise and counter-clockwise directions.

A mechanism is provided to selectively and alternatively prevent and permit rotation of the platter 12 and the turn table 110. The mechanism includes an index lever 16 attached to the frame 14. Specifically, the index lever 16 has a first leg 114 that is attached to the upper tray 92 and extends horizontally over an opening 118 in the upper tray 92. A second leg 116 of the index lever 16 extends upwardly from the first leg 114 to form a handle. A top portion of the second leg 116 may be bent outwardly as shown in FIG. 4 to allow easier activation by an operator. A projection 120 also extends upwardly from the first leg 114 to engage the platter 12.

When the projection 120 engages a recess (not shown) in the underside of the platter 12, the platter 12 and the turn table 110 are prevented from rotating. The second leg 116 can be moved downwardly such that a portion of the index lever 16 extends through the opening 118 in the upper tray 92. In this position of the index lever 16, the projection 120 disengages the platter 12, and the platter 12 and turn table 110 can rotate. The platter 12 may have various recesses, spaced around the platter 12, that are engagable with the projection 120. Accordingly, the index lever 16 is engagable with various portions of the platter 12 such that the platter 12 is prevented from rotating, and the index lever 16 is disengagable from the various portions of the platter 12 such that the platter 12 is rotatable relative to the frame 14.

The recesses in the platter 12 that are engagable and disengagable with the index lever 16 may be spaced around the platter 12 at predetermined locations. The predetermined locations coincide with specific cavities or tool stations 18 so that when the platter 12 is rotated or indexed to engage the index lever 16, a particular cavity 18 is positioned near one side of the work station 10. Preferably, the desired cavity 18 is positioned near the parts tray 22 for easy access to the tool station 18 and the parts tray 22 while servicing a turret tool. The desired cavity 18 may be positioned over a thick turret tool hole 122. A thick turret tool held in place in a cavity 18 may have a length such that the thick tool extends through the platter 12 and the tool hole 122.

The platter 12 of the work station 10, shown in FIG. 1, rotates when an operator turns the platter 12 and turntable 110 by hand. Alternatively, the work station 10 could include a power-assisted mechanism to rotate the platter 12 and the turntable 110. The power-assisted mechanism could include an electric motor, a pneumatic system, a hydraulic system, springs or other forceimparting mechanism, for example.

Figure 5:
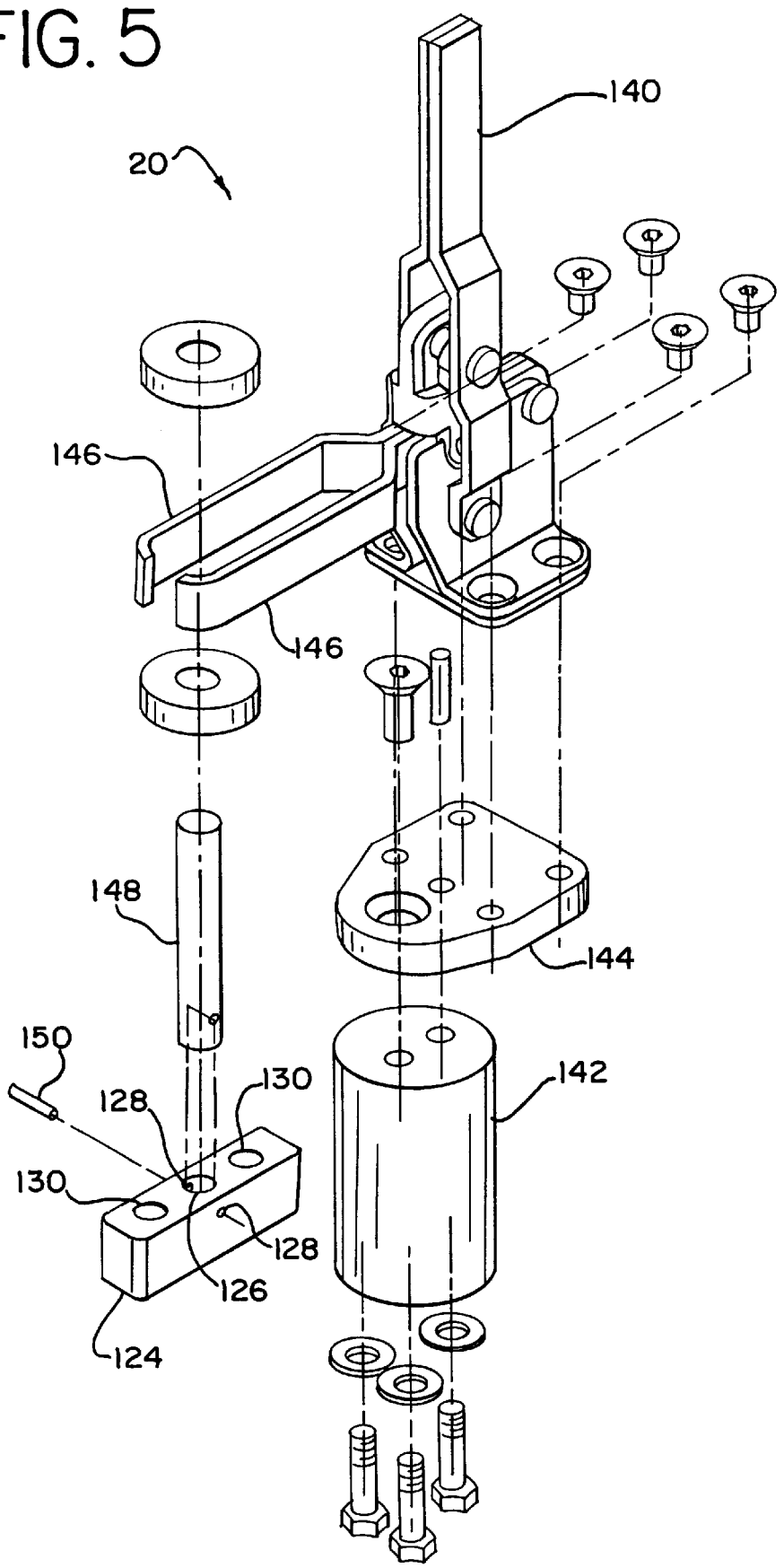
FIG. 5 is an exploded, perspective view of a clamp assembly of the work station.

FIG. 5 shows an exploded, perspective view of a clamp assembly 20 of the work station 10. The clamp assembly 20 includes a clamp 140 mounted to the top of a clamp shaft 142 by a mounting plate 144. The clamp shaft 142 extends through the hole 44 in the center of the platter 12 (FIGS. 2 and 3) to mount the clamp assembly 20 to the upper tray 92 (FIG. 4). The clamp assembly 20, particularly the bottom of the clamp shaft 142, may be attached to the center of the upper tray 92 by another mounting plate (not shown) in the area of the reinforcement bar (not shown).

The clamp assembly 20 is orientated on the work station 10 such that a clamping pad 124 faces the front side of the work station 10. Although the clamp assembly 20 is attached to the upper tray 92 in a fixed position, it is contemplated that the clamp assembly 20 could be constructed to rotate if desired. One clamp 140 that can be used with the clamp assembly 20 is a Series 247-U clamp made by De-Sta-Co, Troy, Mich.

The clamp pad 124 is adjustably attached to a pair of tongs 146 on the clamp 140 by a threaded rod 148, as is known in the industry. The clamp pad 124 is a rectangular shaped bar having a mounting hole 126 in the center of the clamp pad 124 for mounting the pad 124 to the threaded rod 148 and the clamp 140. A hole 128 through the clamp pad 124 is provided for a dowel 150 to extend through a corresponding hole in the threaded rod 148 for attaching the threaded rod 148 to the clamp pad 124. Two vertical clearance holes 130 provide clearance space through the clamp pad 124. A tool, such as an allen wrench, can be inserted through the clearance holes 130 to assemble and disassemble spring-loaded or urethane-loaded dies that are clamped by the clamp assembly 20.

Referring to FIG. 1, the clamp assembly 20, particularly the clamp pad 124, is used to hold a turret tool, particularly a die, within a cavity 18. Specifically, the clamp assembly 20 reaches upright standard die cavities 46, 48, 50 (FIG. 3) to compress spring-loaded or urethane-loaded dies.

The work station 10 may also include a mechanism to prevent the portable work station 10 from moving or rolling on the shop floor surface. FIG. 24 shows a table lock assembly 160 that can be used to prevent the work station 10 from rolling along the shop floor. The table lock assembly 160 includes an upper lock assembly 162 and a lower lock assembly 164 which are slidably engaged, i.e., slidable relative to each other. A resilient lock pad 166 is attached to a bottom side of the lower lock assembly 164. The table lock assembly 160 further includes a lock lever 168 which is actuatable to alternately extend and retract the lower lock assembly 164 from and into the upper lock assembly 162. A spring 167, shown in FIG. 25, is positioned within the upper and lower lock assemblies 162, 164 to bias the table lock assembly 160 in the unlocked mode. The lock pad 138 is engagable with the shop floor in the locked mode and disengagable from the shop floor in the unlocked mode to alternately prevent the work station 10 from moving and permit the work station to move.

FIG. 26 shows the upper lock assembly 162 of the table lock assembly 160. The upper lock assembly 162 includes an upper tube 170 connected, at one end, to a mounting plate 172. A hole 174 through the upper tube 170 is provided for pivotally mounting the lock lever 168 to the upper lock assembly 162. A notch 176 may be provided in one end of the upper tube 170 to engage a corresponding tab 178 on the mounting plate 172. The engagement between the notch 176 and the tab 178 allow for efficient assembly of the upper tube 170 to the center of the mounting plate 172.

The table lock assembly 160 is mounted to the bottom side of the lower tray 24 by the mounting plate 172 and extends away from the lower tray 24, downward toward the shop floor. The bolt pattern 180 on the mounting plate 172, and the corresponding bolt pattern on the lower tray 24, are asymmetrical. The asymmetrical bolt patterns ensure that the table lock assembly 160 is mounted to the work station 10 with the lock lever 168 facing the front side (same side as the parts tray 22) of the work station 10.

The asymmetrical bolt pattern 180 requires the upper tube 170 to be connected to the mounting plate 172 with the hole 174 in the proper angular position relative to the bolt pattern 180. The hole 174 and the notch 176 are positioned in angular alignment with each other. The tab 178 is positioned on the mounting plate 172 such that when the notch 176 and the tab 178 are engaged, the hole 174 is in proper orientation relative to the bolt pattern 180.

FIG. 27 shows the lower lock assembly 164. The lower lock assembly 164 includes a lower tube 182 connected, at one end, to a pad plate 188. A hole 190 through the lower tube 182 is provided for pivotally mounting the lock lever 168 to the lower lock assembly 164. The outside diameter of the lower tube 182 and the inside diameter of the upper tube 170 are selected such that the lower tube 182 is slidable within the upper tube 170 as shown in FIG. 25.

FIG. 28 shows the lock lever 168 of the table lock assembly 160. The lock lever 168 includes a left release tab 192 extending perpendicularly from a left lever side, and a right release tab 196 extending perpendicularly from a right lever side 198. A lock tab 161 connects one end of the left lever side 194 to one end of the right lever side 198. Upper and lower mounting holes 163, 165 are provided through both the left and right lever sides 194, 198. The two upper mounting holes 163 are coaxially aligned, as are the two lower mounting holes 165.

An operator pushes a foot on the lock tab 161 to actuate the lock tab 161 and place the table lock assembly 160 in the locked mode. To release the table lock assembly 160, the operator actuates or pushes a foot on either the left or right release tab 192, 196. One of the release tabs 192, 196 may have a larger face than the other release tab to accommodate various feet sizes. For example, the lock lever 168 shown in FIG. 28 has a left release tab 192 that is larger than the right release tab 196. One of the release tabs 192, 196 may extend vertically higher than the other release tab. As shown in FIG. 24, the left release tab 192 is positioned vertically above the right release tab 196. The vertical height of the left release tab 192 provides greater leverage to release the table lock assembly 160 than the right release tab 196. Actuation of the higher left release tab 192 requires less force to release the table lock assembly 160 than actuation of the lower right release tab 196. The left and right release tabs 192, 196 are also positioned at different vertical heights for ease of manufacturing the lock lever 168 out of a single piece of material.

Referring to FIG. 24, two lock links 169 are pivotally connected to opposite sides of the upper lock assembly 162. An upper mounting rod or screw 173 extends through one end of each lock link 169 and through the hole 174 in the upper tube 170. A second, opposite end of each lock link 169 is pivotally connected to the lock lever 168. Each lock link 169 is pivotally connected to the upper mounting holes 163 on the left and right lever sides 194, 198. The lock lever 168 is pivotally connected to the lower lock assembly 164. A lower mounting rod or screw 175 extends through the lower mounting holes 165 in the left and right lever sides 194, 198 and through the hole 190 in the lower tube 182. Spacers 171 may be included on either side of the lower lock assembly 164 between the left and right lever sides 194, 198 and the lower tube 182. The lower mounting screw 175 extends through the spacers 171. Referring to FIG. 25, opposite ends of the spring 167 are connected to the upper and lower mounting screws 173, 175.

Referring to FIGS. 24 and 25, the work station 10 is prevented from rolling on a shop floor by actuating the table lock assembly 160 to place the table lock assembly 160 in the locked mode. The solid lines in FIG. 25 show the table lock assembly 160 in the locked mode, while the dashed lines show the lock lever 168, the lock links 169, the lower lock assembly 164 and the lock pad 166 in the unlocked mode.

In the unlocked mode, an operator pushes downward on the lock tab 161 to actuate the lock lever 168. As the lock lever 168 is actuated, the lower lock assembly 164 extends downward, toward the shop floor, and the spring 167 is stretched further. The lock pad 166 moves toward the shop floor (away from the lower tray 24), engages the shop floor, and is compressed against the shop floor. The pivotal connections between the lock links 169 and left and right lever sides 194, 198 move from the back side of the table lock assembly 160, through a vertical alignment with the upper and lower mounting screws 173, 175, to the front side, as shown in FIG. 25. Moving the lock links 169 from an angle on one side of vertical to an angle on the other side of vertical maintains the table lock assembly 160 in the locked mode. The retracting tension forces generated by the stretched spring 167 are insufficient to return the table lock assembly 160 back to the unlocked mode. In the locked mode, the compressed, resilient lock pad 166 generates friction against the shop floor and prevents the work station 10 from rolling on the casters 36.

The work station 10 is permitted to roll on the shop floor by actuating the table lock assembly 160 to place the table lock assembly 160 in the unlocked mode. An operator pushes on either the left or right release tabs 192, 196 to unlock the table lock assembly 160. Pushing on the release tabs 192, 196 moves the pivotal connections between the lock links 169 and left and right lever sides 194, 198 from the front side of the table lock assembly 160, through a vertical alignment with the upper and lower mounting screws 173, 175, to the back side, as shown in FIG. 25. The spring 167 retracts the lower lock assembly 164 upward into the upper lock assembly 162. The lock pad 166 is retracted away from the shop floor and upward, toward the lower tray 24. Accordingly, the lock pad 166 disengages the shop floor and the work station 10 can be rolled on the casters 36.

The table lock assembly 160 can be used during the servicing of a turret tool positioned in a tool station or cavity 18, for example. Of course, multiple table lock assemblies 160 may utilized.

The table lock assembly 160 is preferably mounted off center on the lower tray 24 to effectively resist rotational movement of the work station 10. For example, the table lock assembly 160 may be mounted near the front of the work station 10, i.e., on the same side of the work station 10 as the parts tray 22.

Figure 6:
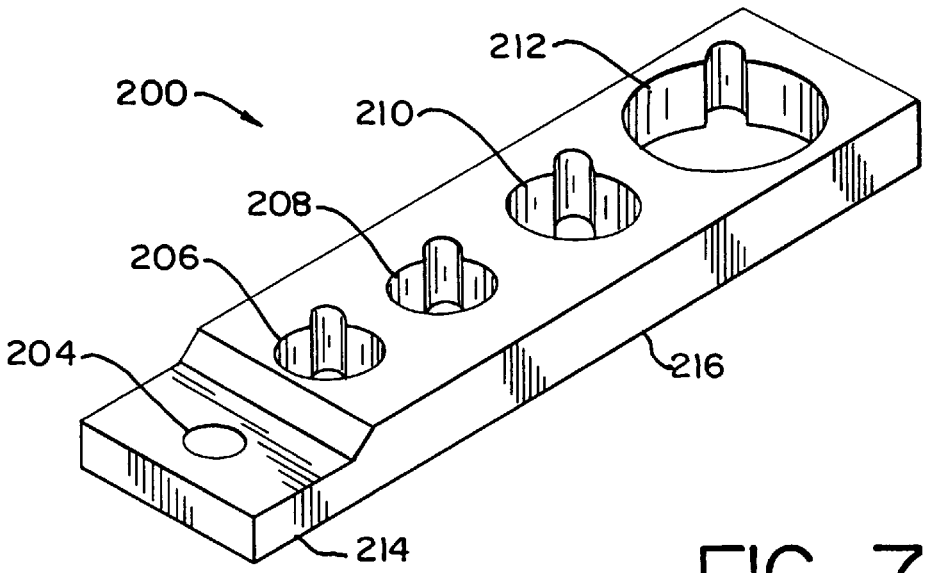
FIG. 6 is a perspective view of a grinder die holder made in accordance with the principles of the present invention.
Figure 7:
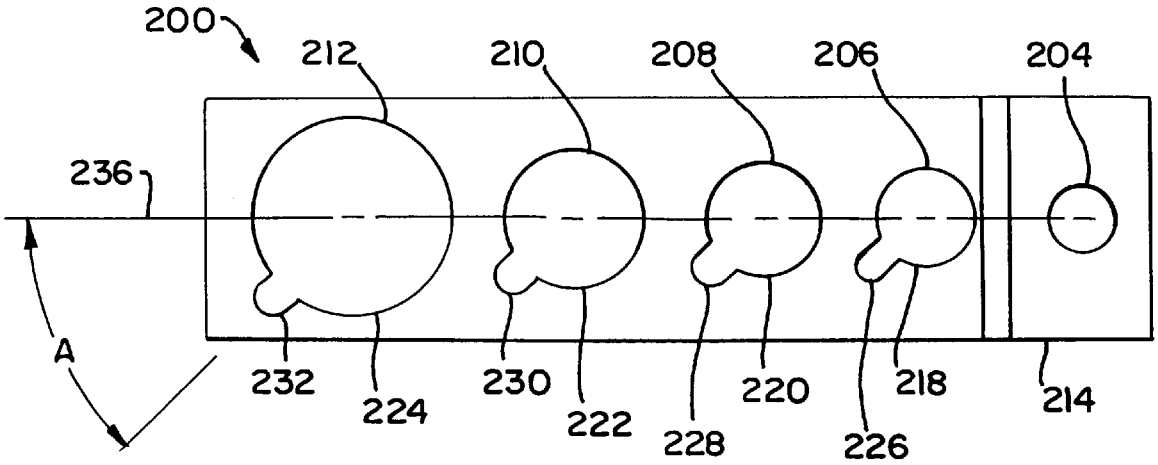
FIG. 7 is a top view of the grinder die holder of FIG. 6.
Figure 8:
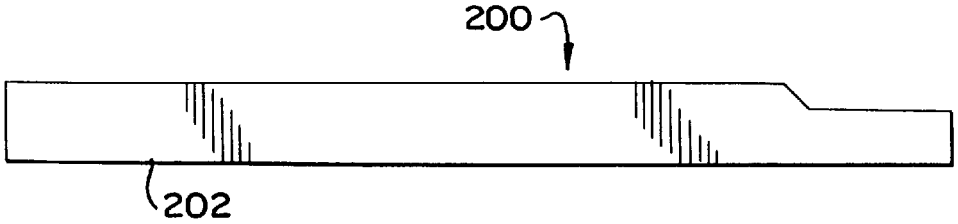
FIG. 8 is a side elevational view of the grinder die holder of FIG. 6.

FIG. 6 shows a grinder die holder 200 made in accordance with the principles of the present invention, FIG. 7 shows a top view of the grinder die holder 200, and FIG. 8 shows a side elevational view of the grinder die holder 200. The grinder die holder 200 is utilized to hold a die portion of a turret tool during grinding of the die, for example, dies for thick, thin or multi-tool turret tooling. As one example, the grinder die holder 200 can hold the die 604 shown in FIG. 30. Other examples of dies for thick and thin turret tooling that the die holder 200 can hold are die sizes 204 (8 mm), 206 (16 mm), 208 (24 mm), 210 (½") and 212 (1¼").

The grinder die holder 200 is conveniently stored on the lower tray 24 of the work station 10, as shown in FIG. 1. Storing the grinder die holder 200 on the lower tray 24 keeps tools used to service turret tooling organized and provides easy access to the grinder die holder 200 when needed. The grinder die holder 200 securely holds a die in proper position during grinding of the die. The grinder die holder 200 surrounds a portion of the die and provides an increased surface area in contact with a magnetic chuck. During grinding of the die, the grinder die holder 200 prevents an edge of the die and the entire die from lifting off of the magnetic chuck, and also prevents the die from sliding or rotating on the chuck.

Referring to FIGS. 6, 7 and 8, the grinder die holder 200 includes a body, shown as a rectangular bar, having a flat bottom surface 202. The flat bottom surface 202 (FIG. 8) is provided so that the grinder die holder 200 can be positioned flat on a magnetic chuck during grinding of a die. The grinder die holder 200 also includes at least one die position 204, preferably multiple die positions 204, 206, 208, 210, 212, for holding a die. As shown in FIGS. 6 and 7, a first portion 214 of the grinder die holder 200 contains the first die position 204, and a second portion 216, which extends from the first portion 214, contains the second through fifth die positions 206, 208, 210, 212. The flat bottom surface 202 of the grinder die holder 200 is formed by the co-planer bottom surfaces of the first and second portions 214, 216.

The first portion 214 may have a thickness less than the second portion 216 because the dies placed in the first die position 204 have a smaller height than the dies placed in the second through fifth die positions 206, 208, 210, 212. The first die position 204 is a circular hole extending through the first portion 214 of the grinder die holder 200. The dies placed in the first die position 204 may be dies used in a multi-tool cartridge, for example. Such dies typically have a round circumference and do not have a key. Accordingly, a keyway is not provided for the first die position 204, in contrast to the keyways provided for the second through fifth die positions 206, 208, 210, 212 described below of course, the first portion 214 can include multiple die positions of various sizes to accommodate various sized dies.

As shown in FIGS. 6 and 7, the grinder die holder 200, particularly the second portion 216, may include multiple die positions 206, 208, 210, 212 having various sizes to accommodate various dies. The die positions 206, 208, 210, 212 increase in size from the second die position 206 to the fifth die position 212. Each die position 206, 208, 210, 212 includes a hole 218, 220, 222, 224 adjacent a keyway 226, 228, 230, 232 which extends into and through the second portion 216 and through the flat bottom surface 202. The holes 218, 220, 222, 224 are circular, and the keyways 226, 228, 230, 232 each have a straight segment extending from the holes 218, 220, 222, 224 and an arcuate segment connected to the straight segment. Each hole 218, 220, 222, 224 and keyway 226, 228, 230, 232 have a shape that corresponds to a shape of a die having a key. Accordingly, the sizes and shapes of the holes and keyways can be selected and designed to accommodate various sizes and shapes of dies and keys.

Referring to FIG. 7, the second through fifth die positions 206, 208, 210, 212 are orientated to provide for good machine shop grinding practices. The keyways 226, 228, 230, 232 are orientated at a 45° angle A to a longitudinal center line 236 along the length of the grinder die holder 200. Common industry practice includes aligning the key on a die along the direction of the longest part of the die cutout. When the die is placed in the grinder die holder 200, the die key is positioned within the keyway 226, 228, 230, 232, and the die cutout will be positioned at a 45° angle to the direction of travel of the grinding wheel.

Referring to FIGS. 1 and 6, the grinder die holder 200 is used by removing it from the lower tray 24 of the work station 10 and removing a turret die from a cavity 18 of the platter 12. The grinder die holder 200 is placed with the flat bottom surface 202 on a magnetic chuck such that the grinder die holder's longitudinal line 236 is aligned with the longitudinal length of the magnetic chuck. In this position, the keyways 226, 228, 230, 232 are orientated at a 45° angle to the longitudinal direction of travel of the grinder wheel. A die is placed in the desired die position 204, 206, 208, 210, 212. If the die is placed in one of the second through fifth die positions 206, 208, 210, 212, then the die key is positioned in the respective keyway 226, 228, 230, 232. The keyway 226, 228, 230, 232 orientates the die cutout at a 45° angle to the direction of grinder wheel travel. Accordingly, the die will be ground in a crosscut manner, which is consistent with good machine shop practice. The keyway 226, 228, 230, 232 also prevents the die from rotating during the grinding process. The magnetic chuck is turned on to securely hold the grinder die holder 200 and the die on the chuck, and the die is ground.

The grinder die holder 200 could include tool positions having shapes other than a circular hole with a keyway, provided the tool position shape conforms to the desired tool to be positioned in the grinder die holder. After use, the grinder die holder 200 is returned to its position on the lower tray 24 of the work station 10, as shown in FIG. 1.

Figure 9:
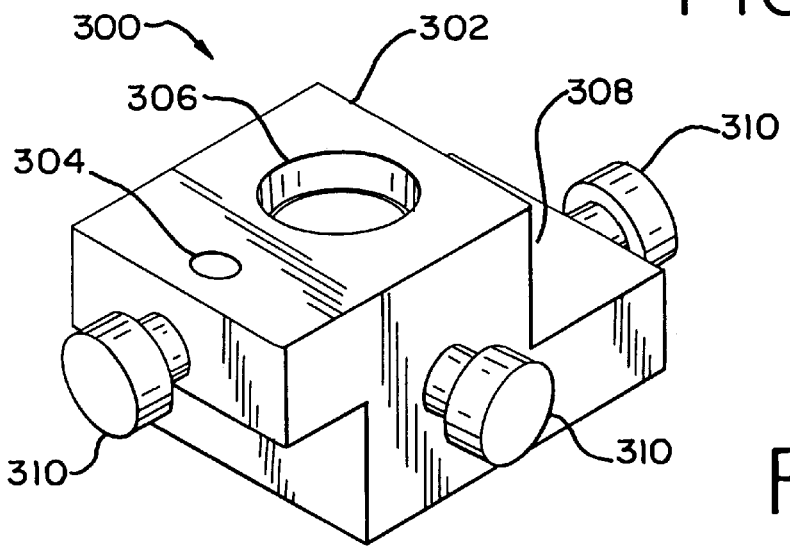
FIG. 9 is a perspective view of a grinder punch holder made in accordance with the principles of the present invention.

FIG. 9 shows a grinder punch holder 300 made in accordance with the principles of the present invention. The grinder punch holder 300 is utilized to hold a punch of a turret tool during grinding of the punch. Particularly, the grinder punch holder 300 is used to hold punches from multi-tool punch cassettes, for example, the punch 608 shown in FIG. 32. The grinder punch holder 300 is conveniently stored on the lower tray 24 of the work station 10, as shown in FIG. 1. Storing the grinder punch holder 300 on the lower tray 24 keeps tools used to service turret tooling organized and provides easy access to the grinder punch holder 300 when needed.

Referring to FIG. 9, the grinder punch holder 300 includes a punch holder body 302 that defines first, second and third punch positions 304, 306, 308. The punch positions 304, 306, 308 are bores or holes extending through the punch holder body 302, and hold the punches in place during grinding of the punches as described below. A thumb screw 310 is provided for each punch position 304, 306, 308 and threadingly extends through a thumb screw hole to secure the punch in its punch position in the punch holder body 302. The diameter of the punch positions 304, 306, 308 can be selected when making the grinder punch holder 300, such that the grinder punch holder 300 can hold punches other than multi-tool punches. Accordingly, the size and shape of the punch positions 304, 306, 308 can be designed to accommodate specific punches.

Figure 10:
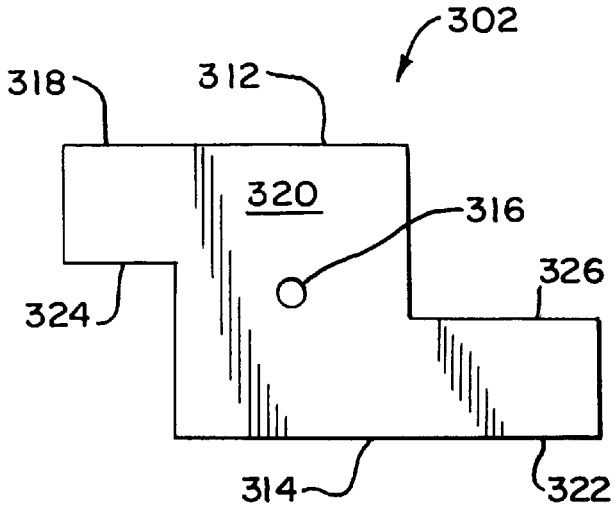
FIG. 10 is a side elevational view of the grinder punch holder of FIG. 9, having thumbscrews removed.

FIG. 10 shows a side elevational view of the punch holder body 302. First and second flat, planar surfaces 312, 314 are provided on opposite sides of the punch holder body 302. The first and second flat surfaces 312, 314 are parallel to each other, and are used to place the grinder punch holder 300 on a magnetic chuck during grinding of the punch. One of the tapped thumb screw holes 316 is shown in FIG. 10 with the thumb screw 310 removed.

Figure 11:
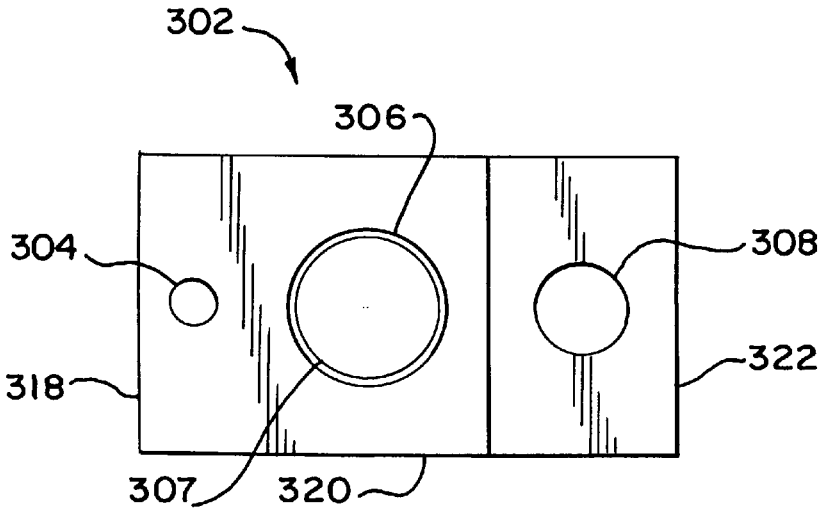
FIG. 11 is a top plan view of the grinder punch holder of FIG. 9, having thumbscrews removed.

Referring to FIGS. 10 and 11, the first punch position 304 is a circular hole extending through a first leg 318 which extends from a mid-section 320 of the punch holder body 302. The second punch position 306 is a circular hole extending through the mid-section 320 of the punch holder body 302. The hole of the second punch position 306 is counterbored to a predetermined depth and forms an annular shoulder 307. The depth of the counterbore corresponds to the length of the punch to accommodate the punch head. Accordingly, the punch head can lay flat on a magnetic grinding chuck along with the first flat surface 312 during grinding of the punch. The third punch position 308 is a circular hole extending through a second leg 322 which extends from the mid-section 320 on an opposite side and in an opposite direction from the first leg 318. The third punch position 308 is larger in diameter than the first punch position 304, and the second punch position 306 is larger in diameter than the third punch position 308. The sizes of the holes for the punch positions 304, 306, 308 are selected to correspond to outside diameters of punches that will be held in the grinder punch holder 300 during grinding of the punch.

Referring to FIGS. 1 and 9, the grinder punch holder 300 is used by removing it from the lower tray 24 of the work station 10 and removing a turret punch from a cavity 18 of the platter 12. When using the first punch position 304 to grind a punch, a punch is inserted tip first into the first punch position 304. The punch tip is inserted into the first punch position 304 from a side 324 of the first leg 318 that is opposite the first flat surface 312. The second flat surface 314 of the punch holder body 302 is placed on a magnetic chuck. The punch is slid within the first punch position 304 until a bottom of the punch is placed in contact with the magnetic chuck. In this position, a punch shaft extends through the first leg 318 and the punch tip extends above the grinder punch holder 300. The thumb screw 310 associated with the first punch position 304 is tightened to securely hold the punch in the grinder punch holder 300. The magnetic chuck is turned on, and the grinder punch holder 300 and the punch are securely held in position for grinding of the punch.

The third punch position 308 is used similarly as the first punch position 304 to grind a punch. The grinder punch holder 300, however, is turned over. The punch tip is inserted into the third punch position 308 from a side 326 of the second leg 322 that is opposite the second flat surface 314. The first flat surface 312 of the punch holder body 302 is placed on a magnetic chuck. The remaining steps to use the third punch position 308 to grind a punch are the same as the steps when using the first punch position 304 to grind a punch.

The second punch position 306 is used to grind a punch by inserting the punch, tip first, into the second punch position 306 from the first flat surface 312 side of the grinder punch holder 300. The punch is inserted into the second punch position 306 until the punch head contacts the annular shoulder 307 defined by the counterbore. The first flat surface 312 is placed on the magnetic chuck such that the punch tip extends upward above the grinder punch holder 300. The remaining steps to use the second punch position 306 to grind a punch are the same as the steps when using the first and third punch positions 304, 308 to grind a punch.

The grinder punch holder 300 securely holds a punch in proper position during grinding of the punch. The grinder punch holder 300 surrounds the shaft of the punch and provides an increased surface area in contact with the magnetic chuck. During grinding of the punch, the thumb screw 310 securely holds the punch in the grinder punch holder 300, and the grinder punch holder 300 prevents an edge of the punch and the entire punch from lifting off of the magnetic chuck. The grinder punch holder 300 also prevents the punch from sliding or rotating on the chuck.

The grinder punch holder 300 is used with relatively small punches, for example, multi-tool punches, which do not have keys. Accordingly, keyways have not been illustrated in the punch positions of FIGS. 9–11. The grinder punch holder 300, however, could include keyways positioned at predetermined orientations and other shaped punch positions so that the grinder punch holder 300 could be used with other punches. After use, the grinder punch holder 300 is returned to its position on the lower tray 24 of the work station 10, as shown in FIG. 1.

Figure 12:
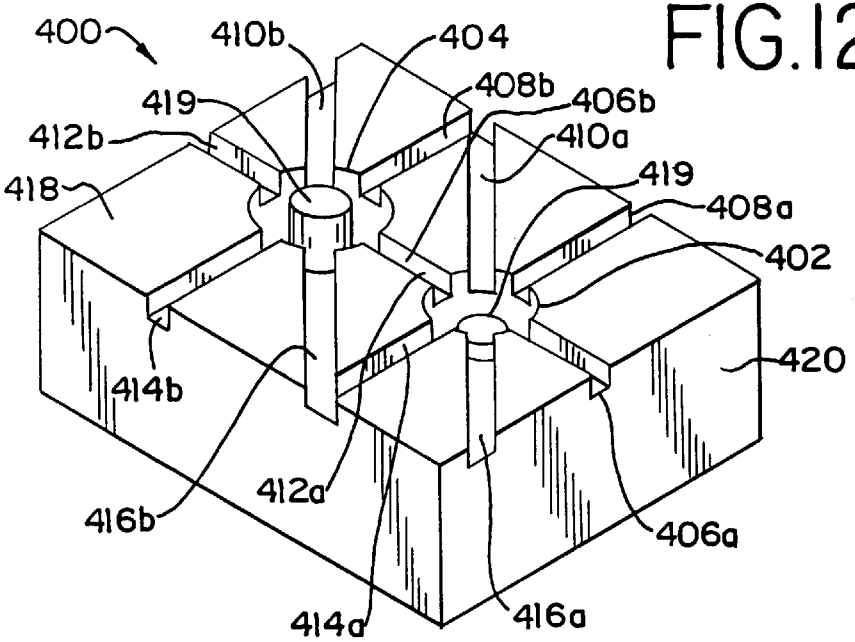
FIG. 12 is a perspective view of another grinder punch holder made in accordance with the principles of the present invention.

FIG. 12 shows another grinder punch holder 400 made in accordance with the principles of the present invention. The grinder punch holder 400 is utilized to hold a punch of a turret tool during grinding of the punch, for example, the punch 606 shown in FIG. 31. The grinder punch holder 400 is designed to hold punches for both thick and thin turret tools. The grinder punch holder 400 is conveniently stored on the lower tray 24 of the work station 10, as shown in FIG. 1. Storing the grinder punch holder 400 on the lower tray 24 keeps tools used to service turret tooling organized and provides easy access to the grinder punch holder 400 when needed.

Referring to FIG. 12, the grinder punch holder 400 defines first and second punch positions 402, 404. The punch positions 402, 404 include bores or holes extending through the grinder punch holder 400, and keyways 406*a,b*, 408*a,b*, 410*a,b*, 412*a,b*, 414*a,b*, 416*a,b* extending radially outward from the holes on a top side 418 of the grinder punch holder 400. A punch is held in one of the punch positions 402, 404 during grinding of the punch by a machine screw 419 and the keyways 406*a,b*, 408*a,b*, 410*a,b*, 412*a,b*, 414*a,b*, 416*a,b* as described below. The diameter of the punch positions 402, 404 can be selected when making the grinder punch holder 400, such that the grinder punch holder 400 is designed to hold various sizes of punches.

Figure 13:
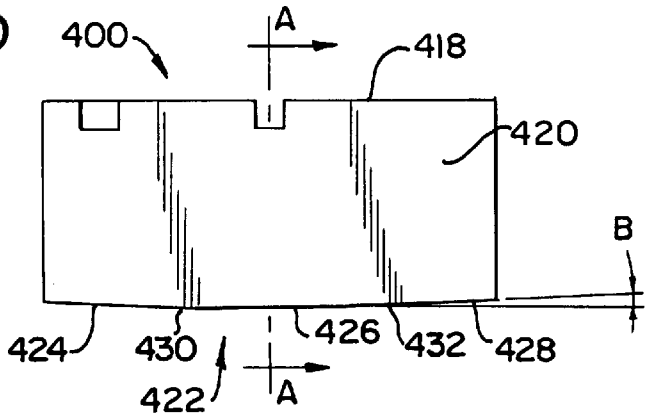
FIG. 13 is a front elevational view of the grinder punch holder of FIG. 12.

FIG. 13 shows a front side 420 and a profile of a bottom side 422 of the grinder punch holder 400. The bottom side 422 of the grinder punch holder 400 includes a left bottom surface 424 adjacent a middle bottom surface 426 which is adjacent a right bottom surface 428. The middle bottom surface 426 is flat and parallel to the top side 418, and extends from the middle of the bottom side 422 (designated by section line A—A) outward in both directions to first and second bottom points 430, 432. The left bottom surface 424 extends from the first bottom point 430 outward and upward at an angle to horizontal. Like-wise, the right bottom surface 428 extends from the second bottom point 432 outward and upward at an angle B to horizontal. Both the left bottom surface 424 and the right bottom surface 428 form a 2½° angle B to horizontal, for example.

Figure 15:
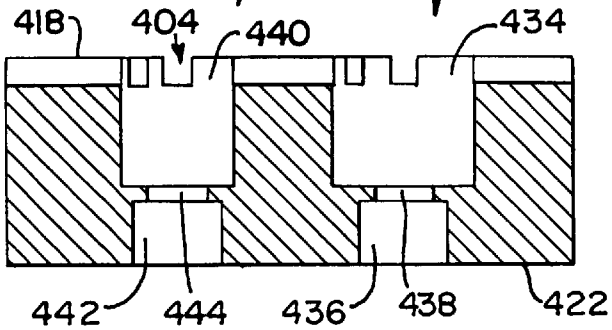
FIG. 15 is a cross-sectional view of the grinder punch holder of FIG. 13 taken along line A—A.

FIG. 15 shows a cross-sectional view of the grinder punch holder 400, with the machine screws 419 removed, taken along the line A—A of FIG. 13. The first punch position 402 includes a circular punch hole 434 extending from the top side 418 downward into the grinder punch holder 400. The diameter and depth of the punch hole 434 is selected so that a base of a punch can be placed within the punch hole 434. A machine screw hole 436 extends from the bottom side 422 upward into the grinder punch holder 400 at a predetermined depth. A hole 438 connects the punch hole 434 and the machine screw hole 436. The machine screw 419 is inserted through the machine screw hole 436 such that the threaded end of the machine screw 419 extends upward into the punch hole 434 and the machine screw head is recessed in the machine screw hole 436. A washer may be placed around the machine screw 419 in the punch hole 434.

Similar to the first punch position 402, the second punch position 404 includes a circular punch hole 440, a machine screw hole 442, a connecting hole 444, a machine screw 419 and a washer. The punch hole 440 of the second punch position 404 has a different diameter than the punch hole 434 of the first punch position 402. Accordingly, a different size punch can be placed in the second punch position 404 than in the first punch position 402.

Figure 14:
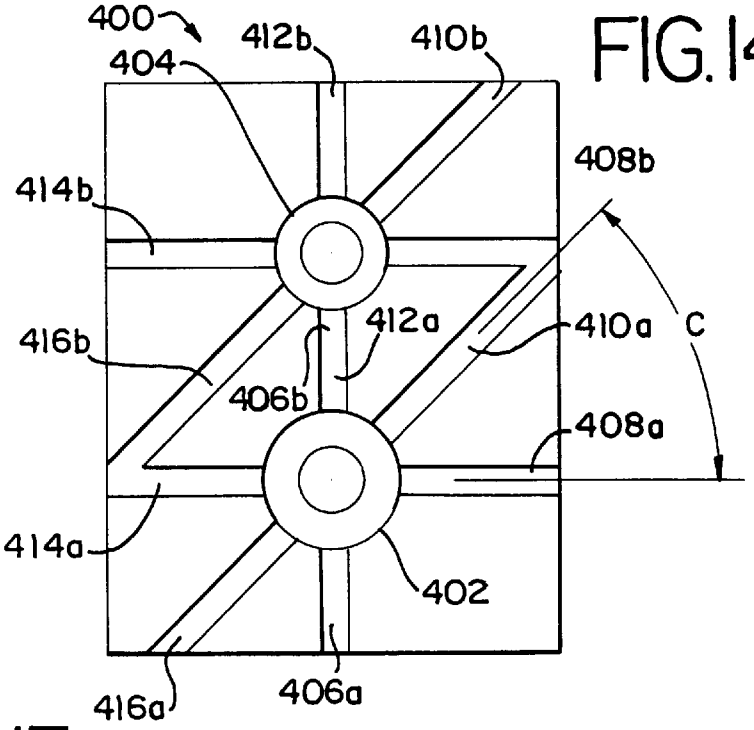
FIG. 14 is a top plan view of the grinder punch holder of FIG. 12.

FIG. 14 shows a top plan view of the grinder punch holder 400. The first punch position 402 has keyways 406*a*, 408*a*, 410*a*, 412*a*, 414*a*, 416*a* extending radially outward, and the second punch position 404 has keyways 406*b*, 408*b*, 410*b*, 412*b*, 414*b*, 416*b* extending radially outward. The keyways 406*a* and 412*a* are perpendicular to the keyways 408*a* and 414*a*. The keyways 410*a* and 416*a* form a 45° angle C with the keyways 406*a*, 408*a*, 412*a*, 414*a*. The keyways 406*b*, 408*b*, 410*b*, 412*b*, 414*b*, 416*b*, extending radially outward from the second punch position 404, are similarly positioned.

Referring to FIGS. 1 and 12, the grinder punch holder 400 is used by removing it from the lower tray 24 of the work station 10 and removing a turret punch from a cavity 18 of the platter 12. The base of the punch is inserted into one of the punch positions 402, 404, particularly one of the punch holes 434, 440, depending on the diameter of the punch. If the punch has a key extending outward from the punch body, one of the keyways 406*a,b*, 408*a,b*, 410*a,b*, 412*a,b*, 414*a,b*, 416*a,b* is selected to receive the key such that the punch will have a desired rotational orientation to the grinding wheel. The punch key is aligned and inserted into the selected keyway, and the punch is secured to the grinder punch holder 400 by the machine screw 419.

The grinder punch holder 400 is placed on a magnetic chuck of a grinder. The grinder punch holder 400 can be placed horizontally on the magnetic chuck by placing the middle bottom surface 426 of the bottom side 422 in contact with the magnetic chuck. In this position, the grinder punch holder 400 provides for flat grinding of the punch tip. The grinder punch holder 400 can also be placed at an angle to the magnetic chuck by placing either the left bottom surface 424 or the right bottom surface 428 in contact with the magnetic chuck. By alternating use of the left bottom surface 424 and the right bottom surface 428, the grinder punch holder 400 provides for roof top grinding of the punch tip. After the punch has been partially ground, the punch can be rotated in the punch position 402, 404 by aligning the punch key with a different keyway 406*a,b*, 408*a,b*, 410*a,b*, 412*a,b*, 414*a,b*, 416*a,b*. Accordingly, the grinder punch holder 400 provides various punch grinding positions to comply with good machine shop practices, and to provide various punch tip shapes, such as flat, roof top, four sided roof top, and concave, for example.

The grinder punch holder 400 securely holds a punch in proper position during grinding of the punch. The grinder punch holder 400 surrounds the body of the punch and provides an increased surface area in contact with the magnetic chuck. During grinding of the punch, the machine screw 419 securely holds the punch in the grinder punch holder 400, and the grinder punch holder 400 prevents an edge of the punch and the entire punch from lifting off of the magnetic chuck. The grinder punch holder 400 also prevents the punch from sliding or rotating on the chuck. After use, the grinder punch holder 400 is returned to its position on the lower tray 24 of the work station 10, as shown in FIG. 1.

FIG. 16 shows another grinder punch holder 500 made in accordance with the principles of the present invention. The grinder punch holder 500 is utilized to hold a punch portion of a turret tool during grinding of the punch, particularly a thick turret tool punch. For example, the grinder punch holder 500 could be used with the punch 602 shown in FIG. 29. The grinder punch holder 500 is particularly designed to hold thick turret tool punches, such as thick punch sizes 512 (½"), 510 (¼") and 508 (1" drop-in). The grinder punch holder 500 is conveniently stored on the lower tray 24 of the work station 10, as shown in FIG. 1. Storing the grinder punch holder 500 on the lower tray 24 keeps tools used to service turret tooling organized and provides easy access to the grinder punch holder 500 when needed.

Referring to FIG. 16, the thick grinder punch holder 500 includes a punch holder top 502, a punch holder body 504, and a punch holder base 506 which form first, second and third thick punch positions 508, 510, 512. The punch holder top 502, body 504, and base 506 are removably attached together as shown in FIG. 16. Dowel pins (not shown) inserted in dowel pin holes 514 in the punch holder top 502 and corresponding dowel pin holes 516 in the punch holder body 504 (FIG. 19) may also be used to assemble the grinder punch holder 500. Referring to FIG. 16, locking members or thumb screws 518 extend through a sidewall of the punch holder top 502 for securing punch tools in the grinder punch holder 500. The three punch positions 508, 510, 512 are sized or dimensioned for three different punches, particularly, thick turret tool punches. For example, the first punch position 508 is designed to hold a punch known in the industry as a "drop in unit," the second punch position 510 is designed to hold a large diameter punch, and the third punch position 512 is designed to hold a small diameter punch. Accordingly, the grinder punch holder 500 shown in FIG. 1 can hold three different sizes of punches.

Preferably, the punch holder top 502 and the punch holder base 506 are constructed from a magnetic material (such as steel), while the punch holder body 504 is constructed from aluminum material. The steel material allows the grinder punch holder 500 to be held securely on a magnetic chuck when the grinder punch holder 500 is positioned upright or laying on a side. The aluminum material reduces the total weight of the grinder punch holder 500 for easier handling and manufacturing. One alternate grinder punch holder 500 could include a steel punch holder top 502 and a steel punch holder body 504. A punch holder base 506 separate from the punch holder body 504 would not be required.

FIG. 17 shows the punch holder top 502 of the grinder punch holder 500. The punch holder top 502 forms a portion of the first punch position 508 by having a first punch position top hole 520 and a first punch position top keyway 522. The first punch position top keyway 522 extends from and is adjacent to the first punch position top hole 520. The first punch position top keyway is shown as a rounded keyway, however, any keyway shape is acceptable as long as the keyway 508 will accept a corresponding key on the punch. A threaded thumb screw hole 524 extends through a sidewall of the punch holder top 502 into communication with the first punch position top hole 520. Similarly, the punch holder top 502 forms portions of the second and third punch positions 510, 512 by having second and third punch position top holes 526, 532, second and third punch position top keyways 528, 534, and threaded thumb screw holes 530, 536, respectively. Each of the three punch position top holes 520, 526, 532 and the three top keyways 522, 528, 534 are sized or dimensioned to accept the particular punch that is placed in the respective first, second or third punch positions 508, 510, 512.

FIG. 18 shows the punch holder base 506 of the grinder punch holder 500. The punch holder base 506 has first, second and third punch position base holes 538, 540, 542 that extend through the punch holder base 506. The punch position base holes 538, 540, 542 are sized to accept the different punches that can be placed in the three punch positions 508, 510, 512. The punch holder base 506 has a flat bottom surface 543 which is approximately perpendicular to the vertical axis of the first, second and third punch positions 508, 510, 512.

FIG. 19 shows the punch holder body 504 of the grinder punch holder 500, and FIG. 20 shows a cross-sectional view of the punch holder body 504 taken along the lines A—A of FIG. 19. The punch holder body 504 includes a first punch position body hole 544 extending through the punch holder body 504 at a constant diameter. The diameter of the first punch position body hole 544 is selected to correspond to an outside diameter of a so-called "drop-in unit" punch tool, such as a one inch drop-in unit for thick turret tooling.

The punch holder body 504 includes a second punch position body upper bore 546 coaxial with a second punch position body lower bore 548. The intersection of the second punch position body upper bore 546 with the second punch position body lower bore 548 forms a second punch position annular shoulder 550 facing upward. The second punch position annular shoulder 550 abuts a corresponding shoulder on a large diameter punch tool when the large punch tool is inserted into the second punch position 510 from the top of the grinder punch holder 500.

The punch holder body 504 includes a third punch position body upper bore 552 coaxial with a third punch position body lower bore 554. The intersection of the third punch position body upper bore 552 with the third punch position body lower bore 554 forms a third punch position annular shoulder 556 facing downward. The third punch position annular shoulder 556 abuts a corresponding shoulder on a small diameter punch tool when the small punch tool is inserted into the third punch position 512 from the bottom of the grinder punch holder 500. A third punch position body keyway 558 is adjacent to and extends along the third punch position body upper bore 552 and the third punch position body lower bore 554. The third punch position body keyway 558 is aligned with the third punch position top keyway 534. Smaller diameter punches typically have a locking ring to retain the punch spring. The third punch position body lower bore 554 is designed to accept the locking ring on the smaller diameter punches. Thus, the locking ring does not have to be removed to grind a small diameter punch.

Figure 16A:
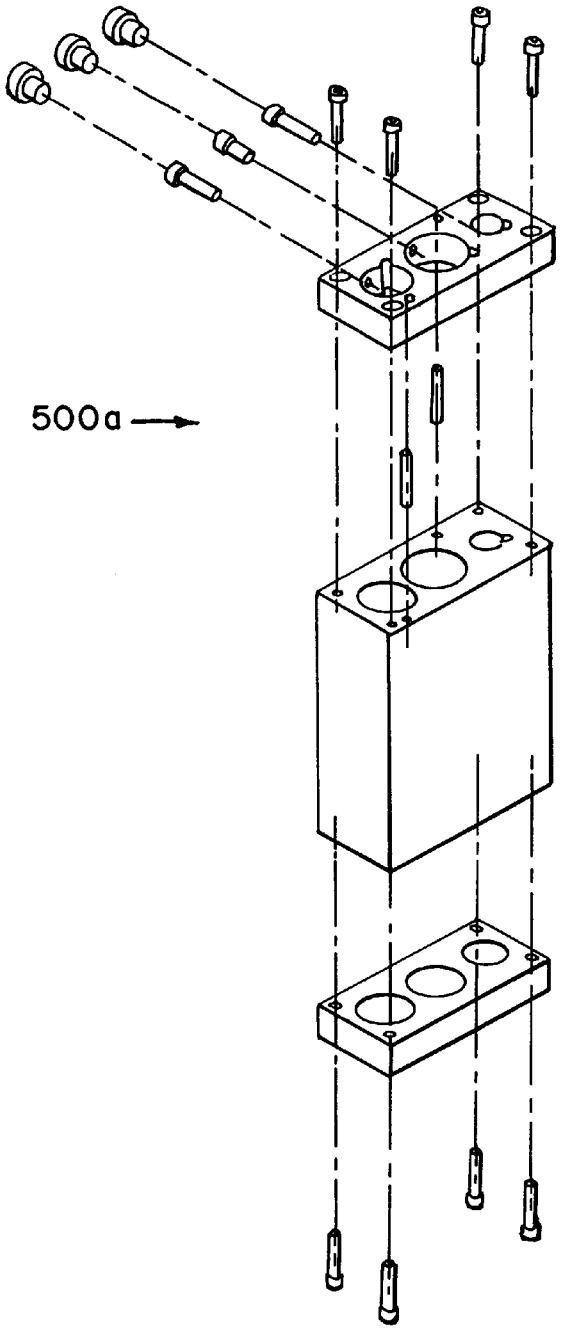
FIG. 16*a* is an exploded perspective view of an alternate grinder punch holder of FIG. 16 made in accordance with the principles of the present invention.

The top keyways 522, 528, 534 are shown in FIGS. 16 and 17 as being aligned with each other. Alternatively, the top keyways 522, 528, 534 can be positioned at other angular orientations. Any keyway in the body 504, such as the body keyway 558 shown in FIG. 19, must be in alignment with its corresponding top keyway. For example, FIG. 16*a* shows one alternate grinder punch holder 500*a* having keyways not aligned with each other, i.e., the keyways are positioned at various angular orientations.

Referring to FIGS. 1 and 16, the grinder punch holder 500 is used by removing it from the lower tray 24 of the work station 108 and removing a punch from a cavity 18 of the platter 12. When using the first punch position 508 to grind a punch, a punch is inserted base first through the punch holder top 502 and into the first punch position 508. Particularly, the punch is inserted through the first punch position top hole 520, through the first punch position body hole 544, and into the first punch position base hole 538. A key on the punch is aligned with the first punch position top keyway 522, and the bottom surface of the punch holder base 506 is placed on a magnetic chuck. The punch is slid within the first punch position 508 until a bottom of the punch is placed in contact with the magnetic chuck. In this position, a punch tip extends above the top of the grinder punch holder 500. The thumb screw 518 associated with the first punch position 508 is tightened to securely hold the punch in the grinder punch holder 500 by moving the thumb screw 518 from outside the first punch position top hole 520 towards the top hole 520. The magnetic chuck is turned on, and the grinder punch holder 500 and the punch are securely held in position for grinding of the punch.

The second punch position 510 is used similarly as the first punch position 508 to grind a punch. A large punch is inserted base first through the punch holder top 502 and into the second punch position 510. Particularly, the punch is inserted through the second punch position top hole 526, through the second punch position body upper bore 546, through the second punch position body lower bore 548, and into the second punch position base hole 540. A key on the punch is aligned with the second punch position top keyway 528, and the punch is slid within the second punch position 510 until the punch is placed in contact with the second punch position annular shoulder 550. The bottom surface of the punch holder base 506 and the bottom of the punch are placed into contact with a magnetic chuck. The remaining steps to use the second punch position 510 to grind a punch are the same as the steps when using the first punch position 508 to grind a punch.

The third punch position 512 is used similarly as the first and second punch positions 508, 510 to grind a punch. A smaller diameter punch, however, is inserted into the grinder punch holder 500 tip first through the bottom (the punch holder base 506) of the grinder punch holder 500. A key on the punch is aligned with the third punch position body keyway 558, and the punch abuts the third punch position annular shoulder 556. The locking ring on the punch fits within the third punch position body lower bore 554. The remaining steps to use the third punch position 512 to grind a punch are the same as the steps when using the first and second punch positions 508, 510 to grind a punch.

The grinder punch holder 500 securely holds a punch in proper position during grinding of the punch. The grinder punch holder 500 surrounds the shaft of the punch and provides an increased surface area in contact with the magnetic chuck. The grinder punch holder 500 may also be placed horizontally on a magnetic chuck. In the horizontal position, any one of the sides of the grinder punch holder 500 contacts the magnetic chuck and the punch axis is horizontally positioned. During grinding of the punch, the thumb screw 518 securely holds the punch in the grinder punch holder 500, and the grinder punch holder 500 prevents an edge of the punch and the entire punch from lifting off of the magnetic chuck. The grinder punch holder 500 also prevents the punch from sliding or rotating on the chuck. Also, the engagement between the punch key and the keyway on the grinder punch holder, and also the thumb screw prevents the punch from rotating in the magnetic chuck. After use, the grinder punch holder 500 is returned to its position on the lower tray 24 of the work station 10, as shown in FIG. 1.

FIG. 21 shows another grinder punch holder 560 made in accordance with the principles of the present invention. The grinder punch holder 560 is similar to the grinder punch holder 500 of FIG. 16, except it is designed to hold thin turret tool punches rather than thick turret tool punches. For example, the grinder punch holder 560 could be used with a thin turret tool punch similar to the punch 602 shown in FIG. 29. The grinder punch holder 560 can hold punches for thin turret tooling, such as punch sizes 568 (⅝" drop-in unit), 570 (¼") and 573 (½"). The thin grinder punch holder 560 includes a punch holder top 562, a punch holder body 564, and a punch holder base 566 which form first, second and third thin punch positions 568, 570, 572. The thin punch holder top 562 and base 566 are the same as the thick punch holder top 502 and base 506 of FIGS. 17 and 18, except for dimensional changes.

FIG. 22 shows the thin punch holder body 564 of the thin grinder punch holder 560, and FIG. 23 shows a cross-sectional view of the punch holder body 564 taken along the line A—A of FIG. 22. The punch holder body 564 includes a first punch position body hole 574 extending through the punch holder body 564 at a constant diameter. The diameter of the first punch position body hole 574 is selected to correspond to an outside diameter of a so-called "drop-in unit" punch tool, such as a ⅝" drop-in unit for thin turret tooling. The first punch position body hole 574 has a first punch position body keyway 576. The first punch position body keyway 576 extends from a top surface of the punch holder body 564 into the body 564 a predetermined distance to receive a corresponding key on the punch.

The punch holder body 564 includes a second punch position body upper bore 578 coaxial with-a second punch position body lower bore 580. The intersection of the second punch position body upper bore 578 with the second punch position body lower bore 580 forms a second punch position annular shoulder 582 facing upward, as similarly described above with reference to FIG. 20. The second punch position body upper bore 578 has a second punch position body keyway 584. The second punch position body keyway 584 extends from the top surface of the punch holder body 564 into the body 564 a predetermined distance to receive a corresponding key on the punch.

The punch holder body 564 includes a third punch position body upper bore 586 coaxial with a third punch position body lower bore 588. The intersection of the third punch position body upper bore 586 with the third punch position body lower bore 588 forms a third punch position annular shoulder 590 facing downward, as similarly described above with reference to FIG. 20. A third punch position body keyway 592 is adjacent and extends along the third punch position body upper bore 586 and the third punch position body lower bore 588, as similarly described above with reference to FIG. 20.

The thin grinder punch holder 560 is used as similarly described above with reference to the thick grinder punch holder 500.

Figure 21A:
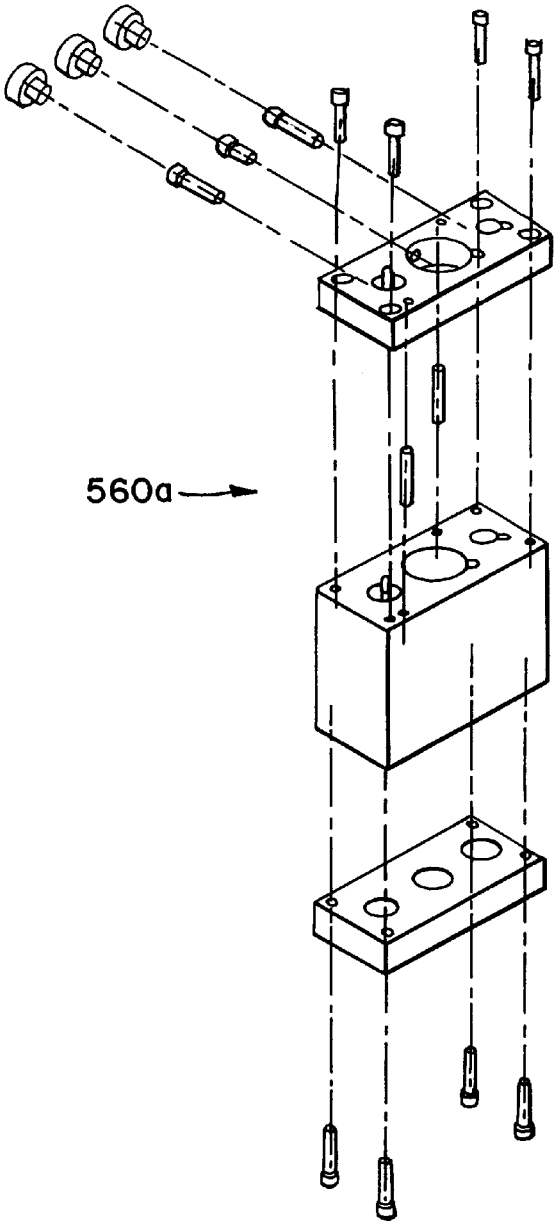
FIG. 21*a* is an exploded perspective view of an alternate grinder punch holder of FIG. 21 made in accordance with the principles of the present invention.
Figure 29:
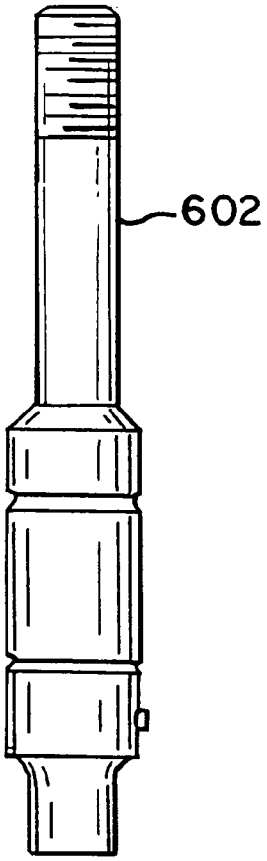
FIG. 29 is a side elevational view of a turret tool punch.
Figure 30:
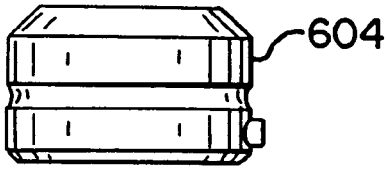
FIG. 30 is a side elevational view of a turret tool die.
Figure 32:
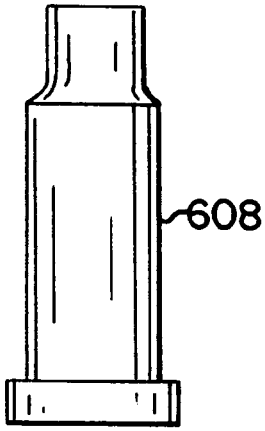
FIG. 32 is a side elevational view of another turret tool punch.
Figure 31:
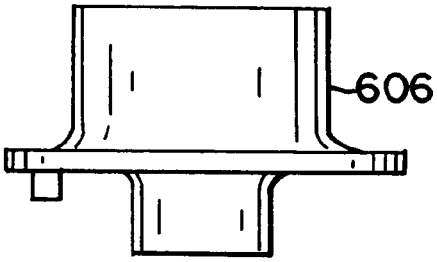
FIG. 31 is a side elevational view of another turret tool punch.

FIG. 21*a* shows one alternate grinder punch holder 560*a* having keyways not aligned with each other, i.e., the keyways are positioned at various angular orientations.

Operation of the work station 10 (rotary assembly and disassembly tool unit) will be described with reference to FIG. 1. The work station 10 is rolled on the casters 36 to a turret punch press machine that requires servicing of a turret tool. Hand tools stored on the parts tray 22 or the lower tray 24 are used to remove the turret tool from or install the turret tool into the punch press machine.

Depending on the specific turret tool removed from the punch press, a desired cavity 18 that will hold the tool in the platter 12 is selected. The index lever 16 is actuated downward to disengage the projection 120 from the recess on the underside of the platter 12. In this position, the first leg 114 of the index lever 16 exerts an upward spring force on the index lever 16. The platter 12 is indexed or rotated, either clockwise or counterclockwise, until the desired cavity 18 is positioned adjacent the parts tray 22 or the clamp pad 124. The index lever 16 is released and the lever 16 is automatically forced upward by the spring force in the first leg 114 such that the projection 120 engages the recess in the platter 12. The platter 12 may need to be rotated somewhat to line up the projection 120 and the recess for proper engagement.

The turret tool is placed in the appropriate cavity 18. If the turret tool and the cavity 18 include pins and grooves (keys and keyways), then the pins or keys are aligned with the grooves or keyways. If use of the clamp 20 is desired, the clamp pad 124 is properly adjusted, and a hand lever on the clamp 20 is actuated to force the clamp pad 124 against the tool and to securely clamp the tool within the cavity 18. With the turret tool properly positioned within the cavity 18, the turret tool can be serviced, for example, disassembled or reassembled. Hand tools and parts stored on the parts tray 22 and the lower tray 24 are used in servicing the turret tool. of course, the punch press machine can be operated, with other turret tools, because the turret tool being serviced is disassembled and assembled outside of cavities in the machine's turret.

The work station 10 may be rolled to another area of the shop to service the tool. For example, if the turret tool requires grinding, the work station is moved to the grinder and the grinding blocks 200, 300, 400, 500, 560 are used to grind the punches and the dies as described above.

While the preferred embodiments have been illustrated and described, numerous changes and modifications can be made without significantly departing from the spirit and scope of this invention. Therefore, the inventor intends that such changes and modifications be covered by the appended claims.

What is claimed is:

1. A work station for turret tooling comprising:

a platter having multiple tool stations defined by spaced-apart cavities recessed into the platter below a top platter surface, each tool station being adapted to receive a turret tool, wherein at least one cavity has a vertical orientation and at least one other cavity has a horizontal orientation; and, a frame supporting the platter.

2. The work station of claim 1 wherein the platter is rotatably mounted on the frame.

3. The work station of claim 2 further comprising means associated with the platter and the frame for preventing rotation of the platter.

4. The work station of claim 3 wherein the means for preventing rotation of the platter comprises a lever attached to the frame, the lever being engagable with the platter such that the platter is prevented from rotating, and the lever being disengagable from the platter such that the platter is rotatable relative to the frame.

5. The work station of claim 1 wherein at least one tool station comprises a finger recess adjacent a cavity and recessed below the top platter surface.

6. The work station of claim 1 wherein the frame is adapted to be movable relative to a surface supporting the work station such that the work station is portable.

7. The work station of claim 1 wherein at least one tool station comprises a groove adjacent a cavity and recessed below the top platter surface, the groove adapted to receive a pin extending from a turret tool.

8. The work station of claim 1 wherein a platter wall defines the cavity, and the platter comprises a pin extending from the platter wall into the cavity.

9. The work station of claim 1 wherein a platter wall defines the cavity, and the platter comprises a spring plunger extending from the platter wall into the cavity.

10. The work station of claim 1 wherein the platter has a circular shape and an annular surface extends downward from a radially outermost edge of the top platter surface, the annular outside surface having a hole extending into the platter.

11. The work station of claim 1 wherein the frame comprises an upper tray in supportive contact with the platter; and a leg extending downward from the upper tray.

12. The work station of claim 11 further comprising a turn table rotatably connected to the upper tray and supporting the platter such that the platter is rotatable relative to the upper tray.

13. The work station of claim 11 further comprising a wheel attached to an end of the leg opposite the upper tray.

14. The work station of claim 11 wherein the frame further comprises a lower tray attached to the leg below the upper tray.

15. The work station of claim 14 further comprising a turret tool grinding block supported by the lower tray.

16. The work station of claim 11 further comprising a parts tray attached to the frame and adapted to hold loose items used in the service of turret tools.

17. The work station of claim 16 wherein the parts tray comprises a bottom slanted relative to a horizontal plane and walls extending upwardly from the bottom.

18. The work station of claim 16 wherein the parts tray defines a tool hole through a parts tray bottom.

19. The work station of claim 1 further comprising a clamp associated with the platter and positioned over a cavity, the clamp capable of clamping a turret tool in a tool station.

20. The work station of claim 19 wherein the clamp is fixedly mounted to the frame and the platter is rotatably mounted to the frame, and the platter rotates relative to the clamp from a first position in which a first cavity is positioned below the clamp to a second position in which a second cavity is positioned below the clamp.

21. The work station of claim 20 wherein the clamp is mounted to the frame by extending through a hole in the platter.

22. The work station of claim 19 wherein the clamp comprises a clamp pad having a hole through the clamp pad to permit access to the turret tool while the turret tool is clamped in a tool station.

23. The work station of claim 6 further comprising a table lock connected to the frame that alternately permits and prevents the work station from moving relative to the surface.

24. The work station of claim 23 wherein the table lock comprises a lock pad engagable with the surface to prevent the work station from moving relative to the surface and disengagable from the surface to permit the work station to move relative to the surface.

25. The work station of claim 23 wherein the table lock comprises:

an upper tube connected to the frame;

a lower tube slidably engaged with the upper tube;

a lock lever mounted to the upper tube and lower tube, the lock lever being actuatable to alternatively extend and retract the lower tube from and into the upper tube; and a resilient lock pad attached to the lower tube.

26. The work station of claim 25 wherein the table lock further comprises a spring connected to the upper tube and the lower tube.

27. The work station of claim 25 wherein the lock lever comprises:

a lock tab connected to the lock lever, the lock tab capable of being actuated to place the table lock in a locked mode; and a first release tab connected to the lock lever, the first release tab capable of being actuated to place the table lock in an unlocked mode.

28. The work station of claim 27 wherein the lock lever further comprises a second release tab connected to the lock lever and having a different size than the first release tab, the second release tab capable of being actuated to place the table lock in the unlocked mode.

29. A work station for turret tooling comprising:

a platter having multiple tool stations defined by spaced-apart cavities recessed into the platter below a top platter surface, each tool station being adapted to receive a turret tool and wherein at least one tool station comprises a groove adjacent a cavity and recessed below the top platter surface, the groove adapted to receive a pin extending from a turret tool; and, a fraine supporting the platter.

* * * * *